US012168544B2

(12) United States Patent
Sekowski

(10) Patent No.: US 12,168,544 B2
(45) Date of Patent: Dec. 17, 2024

(54) HYBRID COLLAPSIBLE CRATE

(71) Applicant: Rehrig Pacific Company, Los Angeles, CA (US)

(72) Inventor: Daniel Vincent Sekowski, Loganville, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 111 days.

(21) Appl. No.: 17/946,631

(22) Filed: Sep. 16, 2022

(65) Prior Publication Data

US 2023/0078746 A1 Mar. 16, 2023

Related U.S. Application Data

(60) Provisional application No. 63/261,269, filed on Sep. 16, 2021.

(51) Int. Cl.
*B65D 6/18* (2006.01)
*B65D 6/34* (2006.01)

(52) U.S. Cl.
CPC ..... *B65D 11/1833* (2013.01); *B65D 11/26* (2013.01)

(58) Field of Classification Search
CPC ..... B65D 11/26; B65D 11/1833; B65D 1/42; B65D 11/18
USPC ..... 220/6; 206/600
See application file for complete search history.

(56) References Cited

U.S. PATENT DOCUMENTS 1,028,933 A 6/1912 Compton
1,330,338 A 2/1920 Peavy
1,389,199 A 8/1921 Leonard
1,407,054 A 2/1922 Farley
1,443,901 A 1/1923 Murray
1,611,629 A 12/1926 Artas
1,671,051 A 5/1928 Soderquist
1,809,523 A 6/1931 McLean
1,869,071 A 7/1932 McLean
1,980,482 A 11/1934 Golden
2,462,693 A 2/1949 Wabshaw
2,497,453 A 2/1950 Hazen
2,667,398 A 1/1954 Claflin
2,714,466 A 8/1955 Killeen
2,731,761 A 1/1956 Marshall
2,759,622 A 8/1956 Simmons et al.
(Continued)

FOREIGN PATENT DOCUMENTS

CA 3016522 A1 * 3/2019 ..... B65D 11/1833
CN 208307241 U * 1/2019 ..... B65D 11/1833
(Continued)

*Primary Examiner* — Rafael A Ortiz

(74) *Attorney, Agent, or Firm* — Carlson, Gaskey & Olds, P.C.

(57) ABSTRACT

A container includes a base having end edges and side edges. The base includes a plurality of regions including a center region, corner portions, side regions between the corner portions and between the center portion and the side edges, and end regions between the corner portions and between the center portion and the end edges. The center region is reinforced differently from the side regions, end regions, and corner regions. The corner regions are reinforced differently from the side regions and the end regions. The center region has no ribs protruding downwardly. A plurality of walls extending upward from the side edges and the end edges of the base.

22 Claims, 21 Drawing Sheets

(56) References Cited

U.S. PATENT DOCUMENTS

| | | | |
|---|---|---|---|
| 2,760,669 | A | 8/1956 | Kreutzer |
| 2,780,381 | A | 2/1957 | Coit, Jr. |
| 2,785,822 | A | 3/1957 | Kus |
| 2,847,794 | A | 8/1958 | Loud et al. |
| 2,868,406 | A | 1/1959 | Kookogey |
| 3,000,049 | A | 9/1961 | Terry, Jr. |
| 3,048,147 | A | 8/1962 | McKean |
| 3,095,965 | A | 7/1963 | Stahl et al. |
| 3,122,127 | A | 2/1964 | Shechmeister et al. |
| 3,130,850 | A | 4/1964 | Oakey et al. |
| 3,220,603 | A | 11/1965 | Bromley |
| 3,311,254 | A | 3/1967 | Beh |
| 3,360,180 | A | 12/1967 | Venturi |
| 3,372,829 | A | 3/1968 | Averill |
| 3,398,850 | A | 8/1968 | Kennard |
| 3,446,145 | A | 5/1969 | Weeks et al. |
| 3,446,415 | A | 5/1969 | Bromley |
| 3,497,127 | A | 2/1970 | Box |
| 3,516,592 | A | 6/1970 | Friedrich |
| 3,591,212 | A | 7/1971 | Rhyne |
| 3,747,794 | A | 7/1973 | Bitney |
| 3,770,186 | A | 11/1973 | Kupersmit |
| 3,782,579 | A | 1/1974 | Zarges |
| 3,796,342 | A | 3/1974 | Sanders et al. |
| 3,804,033 | A | 4/1974 | Izawa et al. |
| 3,814,220 | A | 6/1974 | Brody |
| 3,821,861 | A | 7/1974 | Jalbert |
| 3,853,238 | A | 12/1974 | Luisada et al. |
| 3,874,546 | A | 4/1975 | Sanders et al. |
| 3,941,271 | A | 3/1976 | Zarges et al. |
| 3,955,703 | A | 5/1976 | Zebarth |
| 3,970,209 | A | 7/1976 | Baxter |
| 3,973,692 | A | 8/1976 | Cloyd |
| 3,981,410 | A | 9/1976 | Schurch |
| 4,005,795 | A | 2/1977 | Mikkelsen et al. |
| 4,030,232 | A | 6/1977 | Niva |
| 4,030,600 | A | 6/1977 | Heaps |
| 4,043,476 | A | 8/1977 | Joseph |
| 4,044,910 | A | 8/1977 | Box |
| 4,062,467 | A | 12/1977 | Friedrich |
| 4,081,099 | A | 3/1978 | Shead |
| 4,109,791 | A | 8/1978 | Clipson et al. |
| 4,120,417 | A | 10/1978 | Aquino |
| 4,148,407 | A | 4/1979 | Sinclair |
| 4,159,591 | A | 7/1979 | Plante |
| 4,163,495 | A | 8/1979 | Drader |
| 4,170,313 | A | 10/1979 | Caves et al. |
| 4,181,236 | A | 1/1980 | Prodel |
| 4,186,841 | A | 2/1980 | Buckley et al. |
| 4,192,430 | A | 3/1980 | Cornou |
| 4,235,345 | A | 11/1980 | VandeDrink et al. |
| 4,241,831 | A | 12/1980 | Locatelli |
| 4,300,695 | A | 11/1981 | Hsu |
| 4,314,686 | A | 2/1982 | Marz |
| 4,320,845 | A | 3/1982 | waller |
| 4,342,393 | A | 8/1982 | Box |
| 4,391,369 | A | 7/1983 | Stahl et al. |
| 4,406,380 | A | 9/1983 | Paige |
| 4,417,686 | A | 11/1983 | Wozniacki |
| 4,423,813 | A | 1/1984 | Kreeger et al. |
| 4,591,065 | A | 5/1986 | Foy |
| 4,648,199 | A | 3/1987 | Deaton et al. |
| 4,648,200 | A | 3/1987 | Miller et al. |
| 4,662,532 | A | 5/1987 | Anderson et al. |
| 4,663,803 | A | 5/1987 | Gora |
| 4,676,534 | A | 6/1987 | Hix, Jr. |
| 4,693,386 | A | 9/1987 | Hughes et al. |
| 4,720,020 | A | 1/1988 | Su |
| 4,726,486 | A | 2/1988 | Masuda |
| 4,735,330 | A | 4/1988 | Hoss |
| 4,735,331 | A | 4/1988 | Keenan et al. |
| 4,759,149 | A | 7/1988 | Dunn |
| 4,775,068 | A | 10/1988 | Reiland et al. |
| 4,781,300 | A | 11/1988 | Long |
| 4,798,304 | A | 1/1989 | Rader |
| 4,807,774 | A | 2/1989 | Karpisek |
| 4,820,383 | A | 4/1989 | Shchamorov et al. |
| 4,846,089 | A | 7/1989 | Cedergreen |
| 4,848,578 | A | 7/1989 | Schafer |
| 4,863,062 | A | 9/1989 | Holliday |
| 4,887,747 | A | 12/1989 | Ostrowsky et al. |
| 4,887,874 | A | 12/1989 | Joffe |
| 4,909,188 | A | 3/1990 | Tominaga |
| 4,917,255 | A | 4/1990 | Foy et al. |
| 4,923,079 | A | 5/1990 | Foy |
| 4,953,735 | A | 9/1990 | Tisbo et al. |
| 4,960,223 | A | 10/1990 | Chiang et al. |
| 4,967,927 | A | 11/1990 | Reiland et al. |
| 5,016,772 | A | 5/1991 | Wilk |
| 5,022,529 | A | 6/1991 | Kang |
| 5,038,953 | A | 8/1991 | Radar |
| 5,048,715 | A | 9/1991 | Wolff |
| 5,076,457 | A | 12/1991 | Marovskis |
| 5,092,270 | A | 3/1992 | Simons et al. |
| 5,094,356 | A | 3/1992 | Miller |
| 5,109,980 | A | 5/1992 | Matsuoka et al. |
| 5,114,037 | A | 5/1992 | Hillis et al. |
| 5,161,709 | A | 11/1992 | Oestreich, Jr. |
| 5,199,592 | A | 4/1993 | Reiland et al. |
| 5,289,935 | A | 3/1994 | Hillis et al. |
| 5,331,763 | A | 7/1994 | Miller |
| 5,398,834 | A | 3/1995 | Umiker |
| 5,398,835 | A | 3/1995 | Blinstrub |
| 5,429,261 | A | 7/1995 | Machino |
| 5,467,885 | A | 11/1995 | Blinstrub |
| 5,474,197 | A | 12/1995 | Hillis et al. |
| 5,501,354 | A | 3/1996 | Stromberg |
| 5,515,987 | A | 5/1996 | Jacques et al. |
| 5,538,153 | A | 7/1996 | Marovskis et al. |
| 5,558,241 | A | 9/1996 | Huffstutler, Jr. et al. |
| 5,562,224 | A | 10/1996 | Pascal et al. |
| 5,564,599 | A | 10/1996 | Barber et al. |
| 5,586,675 | A | 12/1996 | Borsboom et al. |
| 5,588,549 | A | 12/1996 | Furtner |
| 5,595,305 | A | 1/1997 | Hart |
| 5,622,276 | A | 4/1997 | Simmons |
| 5,632,114 | A | 5/1997 | McKenzie |
| 5,632,392 | A | 5/1997 | Oh |
| 5,660,291 | A | 8/1997 | Dash |
| 5,671,857 | A | 9/1997 | Stromberg |
| 5,699,926 | A | 12/1997 | Jacques et al. |
| 5,720,405 | A | 2/1998 | Karpisek |
| 5,746,342 | A | 5/1998 | Jacques et al. |
| 5,788,103 | A | 8/1998 | Wagner et al. |
| 5,797,508 | A | 8/1998 | Loftus et al. |
| 5,829,617 | A | 11/1998 | Umiker |
| 5,853,099 | A | 12/1998 | Lessard |
| 5,918,743 | A | 7/1999 | Uitz |
| 5,938,059 | A | 8/1999 | Luburic |
| 5,950,546 | A | 9/1999 | Brown et al. |
| 5,967,356 | A | 10/1999 | Laarhoven et al. |
| 5,975,324 | A | 11/1999 | Schmitt |
| 5,988,420 | A | 11/1999 | Jacques et al. |
| 6,015,056 | A | 1/2000 | Overholt et al. |
| 6,029,840 | A | 2/2000 | Brauner |
| D423,217 | S | 4/2000 | Varfeldt |
| D424,299 | S | 5/2000 | Varfeldt |
| 6,056,177 | A | 5/2000 | Schneider |
| 6,073,790 | A | 6/2000 | Umiker |
| 6,082,570 | A | 7/2000 | Tai |
| 6,098,827 | A | 8/2000 | Overholt et al. |
| 6,131,757 | A | 10/2000 | Clark et al. |
| 6,138,851 | A | 10/2000 | Townson |
| 6,142,329 | A | 11/2000 | Dotan |
| 6,170,689 | B1 | 1/2001 | Flesher et al. |
| 6,189,695 | B1 | 2/2001 | Ching-rong |
| 6,209,742 | B1 | 4/2001 | Overholt et al. |
| 6,267,079 | B1 | 7/2001 | Eby |
| 6,283,319 | B1 | 9/2001 | Hillis et al. |
| 6,286,701 | B1 | 9/2001 | Umiker |
| 6,290,081 | B1 | 9/2001 | Merey |
| 6,293,417 | B1 | 9/2001 | Varfeldt |
| 6,293,418 | B1 | 9/2001 | Ogden et al. |
| 6,305,566 | B1 | 10/2001 | Pigott et al. |

(56) References Cited

U.S. PATENT DOCUMENTS

| | | | |
|---|---|---|---|
| D452,614 | S | 1/2002 | Overholt |
| 6,386,388 | B1 | 5/2002 | Overholt |
| D458,753 | S | 6/2002 | Overholt et al. |
| 6,398,054 | B1 | 6/2002 | Overholt et al. |
| 6,401,953 | B2 | 6/2002 | Kofod |
| 6,405,888 | B1 | 6/2002 | Overholt et al. |
| 6,409,041 | B1 | 6/2002 | Overholt et al. |
| 6,415,938 | B1 | 7/2002 | Karpisek |
| 6,446,825 | B1 | 9/2002 | Godoy |
| 6,460,717 | B1 | 10/2002 | Smyers et al. |
| D466,392 | S | 12/2002 | Halajko |
| 6,488,168 | B1 | 12/2002 | Wang |
| 6,601,724 | B1 | 8/2003 | Koefleda et al. |
| 6,623,059 | B2 | 9/2003 | Gehring et al. |
| 6,631,822 | B1 | 10/2003 | Overholt |
| 6,669,044 | B2 | 12/2003 | Murakami et al. |
| 6,691,885 | B2 | 2/2004 | Brown |
| 6,702,135 | B2 | 3/2004 | Pickler |
| 6,722,516 | B1 | 4/2004 | Zelko |
| 6,772,897 | B2 | 8/2004 | Kellerer et al. |
| 6,820,761 | B1 | 11/2004 | Mouri et al. |
| 6,863,180 | B2 | 3/2005 | Apps et al. |
| 6,899,242 | B2 | 5/2005 | Overholt et al. |
| 6,918,502 | B1 | 7/2005 | Overholt et al. |
| 6,981,605 | B2 | 1/2006 | Kasuya et al. |
| 7,011,225 | B2 | 3/2006 | Oster et al. |
| 7,017,765 | B2 | 3/2006 | Overholt |
| 7,017,766 | B2 | 3/2006 | Hsu et al. |
| 7,044,319 | B2 | 5/2006 | Overholt et al. |
| 7,048,134 | B1 | 5/2006 | Hagan |
| 7,059,489 | B2 | 6/2006 | Apps et al. |
| 7,100,786 | B2 | 9/2006 | Smyers |
| 7,104,414 | B2 | 9/2006 | Apps et al. |
| 7,128,231 | B2 | 10/2006 | Overholt |
| 7,195,127 | B2 | 3/2007 | Hsu et al. |
| 7,195,128 | B2 | 3/2007 | Murakami et al. |
| 7,264,122 | B2 | 9/2007 | Koefelda et al. |
| 7,267,227 | B2 | 9/2007 | Dubois et al. |
| 7,281,637 | B2 | 10/2007 | Hadar |
| 7,353,962 | B2 | 4/2008 | Parall et al. |
| 7,357,269 | B2 | 4/2008 | Apps |
| 7,438,197 | B2 | 10/2008 | Yamauchi |
| 7,484,634 | B2 | 2/2009 | Apps |
| 7,533,486 | B2 | 5/2009 | Ribeiro De Matos |
| 7,549,550 | B2 | 6/2009 | Smyers et al. |
| 7,556,166 | B2 | 7/2009 | Parall et al. |
| 7,641,066 | B2 | 1/2010 | Baltz |
| 7,694,836 | B2 | 4/2010 | Overholt et al. |
| 7,717,283 | B2 | 5/2010 | Apps et al. |
| 7,726,502 | B2 | 6/2010 | Apps |
| 7,740,146 | B2 | 6/2010 | Cavalcante et al. |
| 7,823,728 | B2 | 11/2010 | Baltz |
| D628,801 | S | 12/2010 | Talbot Pouliot et al. |
| 7,861,458 | B2 * | 1/2011 | Apps ..... B65D 11/1833 220/254.1 |
| 7,896,184 | B2 | 3/2011 | Meers |
| 8,056,723 | B2 | 11/2011 | Cavalcante |
| 8,066,147 | B2 | 11/2011 | Meers et al. |
| 8,091,706 | B2 | 1/2012 | Koefelda |
| 8,266,000 | B1 | 9/2012 | Harris |
| 8,561,836 | B2 | 10/2013 | Cook |
| 8,821,840 | B2 | 9/2014 | Schafer et al. |
| 9,278,775 | B2 | 3/2016 | Meers et al. |
| 11,597,557 | B2 * | 3/2023 | Ward ..... B65D 11/1833 |
| 2002/0070215 | A1 | 6/2002 | Walsh et al. |
| 2002/0092850 | A1 | 7/2002 | Iwahara et al. |
| 2002/0108950 | A1 | 8/2002 | Moorman et al. |
| 2002/0158067 | A1 | 10/2002 | Overholt et al. |
| 2003/0000950 | A1 | 1/2003 | Murakami et al. |
| 2003/0116564 | A1 | 6/2003 | Overholt et al. |
| 2003/0132228 | A1 | 7/2003 | Apps et al. |
| 2003/0136781 | A1 | 7/2003 | Rumpel |
| 2003/0155275 | A1 | 8/2003 | Apps et al. |
| 2003/0222081 | A1 | 12/2003 | Apps et al. |
| 2004/0020821 | A1 | 2/2004 | Koefelda et al. |
| 2004/0069780 | A1 | 4/2004 | Apps et al. |
| 2004/0099662 | A1 | 5/2004 | Overholt |
| 2004/0104231 | A1 | 6/2004 | Hassell et al. |
| 2004/0129700 | A1 | 7/2004 | Oster et al. |
| 2004/0159659 | A1 | 8/2004 | Rumpel |
| 2004/0178197 | A1 | 9/2004 | Hsu et al. |
| 2004/0182858 | A1 | 9/2004 | Smyers |
| 2004/0200833 | A1 | 10/2004 | Dubois et al. |
| 2004/0226945 | A1 | 11/2004 | Hsu et al. |
| 2005/0040166 | A1 | 2/2005 | Nolet et al. |
| 2005/0098556 | A1 | 5/2005 | Kellerer |
| 2005/0121447 | A1 | 6/2005 | Barth |
| 2005/0155967 | A1 | 7/2005 | Vial |
| 2005/0194382 | A1 | 9/2005 | B. |
| 2006/0011627 | A1 | 1/2006 | Overholt et al. |
| 2006/0181101 | A1 | 8/2006 | Reynolds et al. |
| 2006/0231555 | A1 | 10/2006 | Smyers et al. |
| 2006/0237341 | A1 | 10/2006 | McDade |
| 2006/0260976 | A1 | 11/2006 | Apps |
| 2007/0095842 | A1 | 5/2007 | Apps |
| 2007/0125779 | A1 | 6/2007 | Cope |
| 2007/0158345 | A1 | 7/2007 | Booth et al. |
| 2007/0187276 | A1 | 8/2007 | Stahl |
| 2007/0194023 | A1 | 8/2007 | Apps et al. |
| 2008/0142399 | A1 | 6/2008 | Apps |
| 2008/0142530 | A1 | 6/2008 | Meers et al. |
| 2008/0169285 | A1 | 7/2008 | Marazita et al. |
| 2008/0179322 | A1 | 7/2008 | Pamall et al. |
| 2008/0296308 | A1 | 12/2008 | Barbalho et al. |
| 2008/0302791 | A1 | 12/2008 | Baltz |
| 2009/0057320 | A1 | 3/2009 | Meers et al. |
| 2009/0078701 | A1 | 3/2009 | Cavalcante |
| 2009/0134157 | A1 | 5/2009 | Meers |
| 2009/0151226 | A1 | 6/2009 | Apps et al. |
| 2009/0159593 | A1 | 6/2009 | Apps |
| 2009/0223953 | A1 | 9/2009 | Cavalcante |
| 2010/0065558 | A1 | 3/2010 | Cavalcante et al. |
| 2011/0290811 | A1 | 12/2011 | Koefelda et al. |
| 2012/0037647 | A1 | 2/2012 | Cook |
| 2012/0111859 | A1 | 5/2012 | Pils et al. |
| 2012/0285951 | A1 | 11/2012 | Cavalcante |
| 2013/0193153 | A1 | 8/2013 | Baltz et al. |
| 2016/0185487 | A1 | 6/2016 | Meers et al. |
| 2019/0071234 | A1 * | 3/2019 | Apps ..... B65D 81/261 |

FOREIGN PATENT DOCUMENTS

| | | | |
|---|---|---|---|
| EP | 73357 | A2 | 3/1983 |
| EP | 0127414 | A2 | 12/1984 |
| EP | 0178211 | A1 | 4/1986 |
| EP | 211116 | A2 | 2/1987 |
| EP | 385914 | A2 | 9/1990 |
| EP | 0404041 | A1 | 12/1990 |
| EP | 0485672 | A1 | 5/1992 |
| EP | 0690003 | A1 | 1/1996 |
| EP | 785142 | A1 | 7/1997 |
| EP | 0962394 | A1 | 12/1999 |
| EP | 962396 | A1 | 12/1999 |
| EP | 1114779 | A2 | 7/2001 |
| EP | 1160169 | A2 | 12/2001 |
| EP | 1225131 | A1 | 7/2002 |
| EP | 1241105 | A1 | 9/2002 |
| GB | 2068338 | A | 8/1981 |
| GB | 2139189 | A | 11/1984 |
| GB | 2141778 | A | 1/1985 |
| GB | 2337985 | A | 12/1999 |
| GB | 2357078 | A | 6/2001 |
| GB | 2360762 | A | 10/2001 |
| GB | 2449502 | A | 11/2008 |
| KR | 20200077994 | A * | 7/2020 |
| WO | 8601182 | A1 | 2/1986 |
| WO | 9324378 | A1 | 12/1993 |
| WO | 9521773 | A1 | 8/1995 |
| WO | 9749613 | A1 | 12/1997 |
| WO | 0027716 | A1 | 5/2000 |
| WO | 0066440 | A1 | 11/2000 |
| WO | 0234630 | A1 | 5/2002 |
| WO | 03008275 | A2 | 1/2003 |
| WO | 03078259 | A1 | 9/2003 |

(56) References Cited

FOREIGN PATENT DOCUMENTS

| | | | |
|---|---|---|---|
| WO | 03101846 | A1 | 12/2003 |
| WO | 2006010311 | A1 | 2/2006 |
| WO | 2008145977 | A1 | 12/2008 |
| WO | 2011006654 | A1 | 1/2011 |

* cited by examiner

Inside

Outside

HYBRID COLLAPSIBLE CRATE

BACKGROUND

Collapsible crates include a base and a plurality of walls hingeably connected to the base. When empty, the walls can be collapsed onto the base (or outward of the base) to reduce their volume for shipping and storage. Typically, the base includes an upper surface upon which goods are supported and a plurality of ribs extending downward therefrom to reinforce the base.

SUMMARY

Generally, the base of the crate is designed to have many smooth, flat surfaces on a lower surface of the base, rather than on the upper surface of the base. Any ribs on the lower surface of the base are recessed or flush with adjacent horizontal wall portions. A large majority of the lower surface of the base is the horizontal wall portions providing smooth flat surfaces. In particular, in a center region of the base, there are only horizontal wall portions (or a single large horizontal wall portion) with a plurality of ribs projecting upwardly therefrom. There are no ribs or other projections on the underside of the center region of the base. Further the density of the ribs in the center region is higher than in other regions of the base to increase stiffness.

When the crate is stacked on top of another crate and both crates are loaded with items, especially heavy items like meat, the base will deflect downward. The center region of the base will deflect downward the most. If the crates contain bags, such as modified atmosphere package (MAP) bags, containing meat or other product, the base of the upper crate may contact the bags (or other packaging) in the lower crate. The smooth lower surfaces of the base prevent damages to the bag or other packaging in the lower crate. Again, because the center region of the upper crate will deflect downward the most, the center region has an increased area of smooth, flat surfaces on the lower surface (e.g. 100%). The increased concentration of ribs extending upward in the center region also increases the rigidity of the center region and reduces deflection.

Other regions of the base may contain alternating or otherwise mixed upper horizontal wall portions with ribs projecting downward and lower horizontal wall portions with ribs projecting upward. The ribs projecting downward are recessed or flush with the lower horizontal wall portions, again to protect a bag or other packaging in the lower crate. It has also been found that this arrangement increases the overall stiffness of the base.

Additionally, in one example disclosed herein, all four walls are provided with handle openings, while in the other example disclosed herein, only the two shorter walls have handle openings.

DETAILED DESCRIPTION

Figure 1:
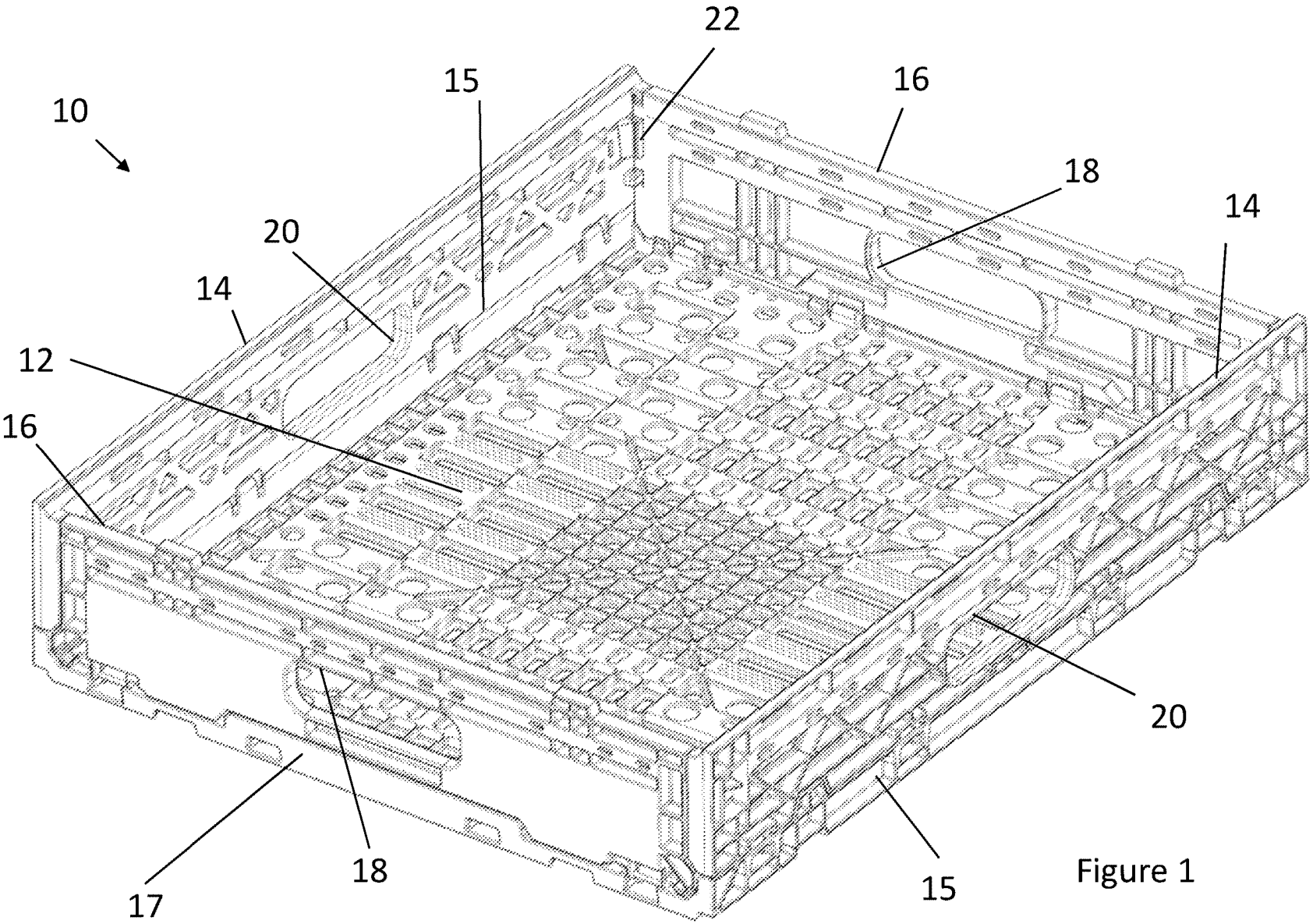
FIG. 1 is a perspective view of a crate according to a first embodiment.

One example of a collapsible crate 10 according to the present invention is shown in FIG. 1. The collapsible crate 10 includes a base 12. A pair of opposed side walls 14 are pivotably connected to side upstanding flanges 15 at side edges of the base 12. A pair of opposed end walls 16 are pivotably connected at end edges of the base 12. The side upstanding flanges 15 are formed integrally with the base 12. The base 12, side walls 14 and end walls 16 are each separately integrally molded of a suitable plastic, such as by injection molding.

The end walls 16 have handle openings 18 formed therethrough. The side walls 14 have handle openings 20 formed therethrough. Latches 22 (only one visible) selectively connect adjacent side walls 14 and end walls 16 in a known manner. End upstanding flanges 17 project upward at ends of the base 12 and are formed integrally with the base 12. In FIG. 1, the end walls 16 and side walls 14 are shown in their upright, use position.

Figure 2:
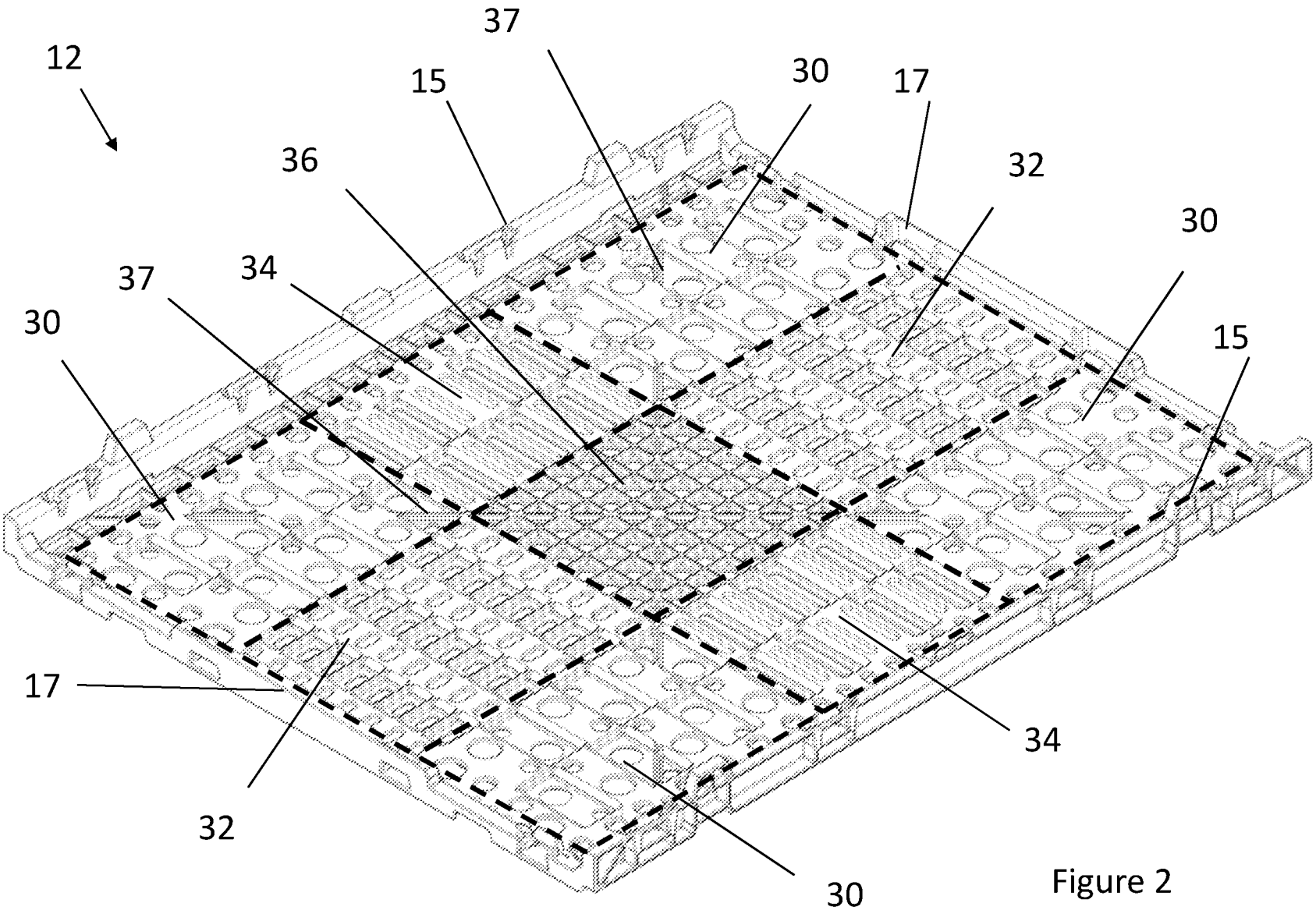
FIG. 2 is an upper perspective view of the base of the crate of FIG. 1.

FIG. 2 shows the base 12 of the container of FIG. 1. Generally, the base 12 includes a plurality of corrugations, channels, and ribs to reinforce the base 12; however, unlike the typical base of a plastic crate, the number of ribs projecting downward of the base 12 is minimized, and the ribs that do project downward of the base 12 are recessed relative to or flush with flat surfaces. Referring to FIG. 2, the base 12 can be considered to have a plurality of different regions, reinforced in several different ways. In the example shown, the base 12 is conceptually divided into nine regions (arranged in a 3×3 array) as shown by the broken lines. Corner regions 30 are defined in each corner of the base 12. End regions 32 are formed adjacent each end edge of the base 12 between the corner regions 30. Side regions 34 are defined adjacent each side edge of the base 12 between the corner regions 30. A center region 36 is defined in the center of the base 12 between the corner regions 30, the end regions 32, and the side regions 34. Diagonal ribs 37 each extend from one corner of the base 12 to the opposite corner and intersect in the center of the base 12.

Figure 3:
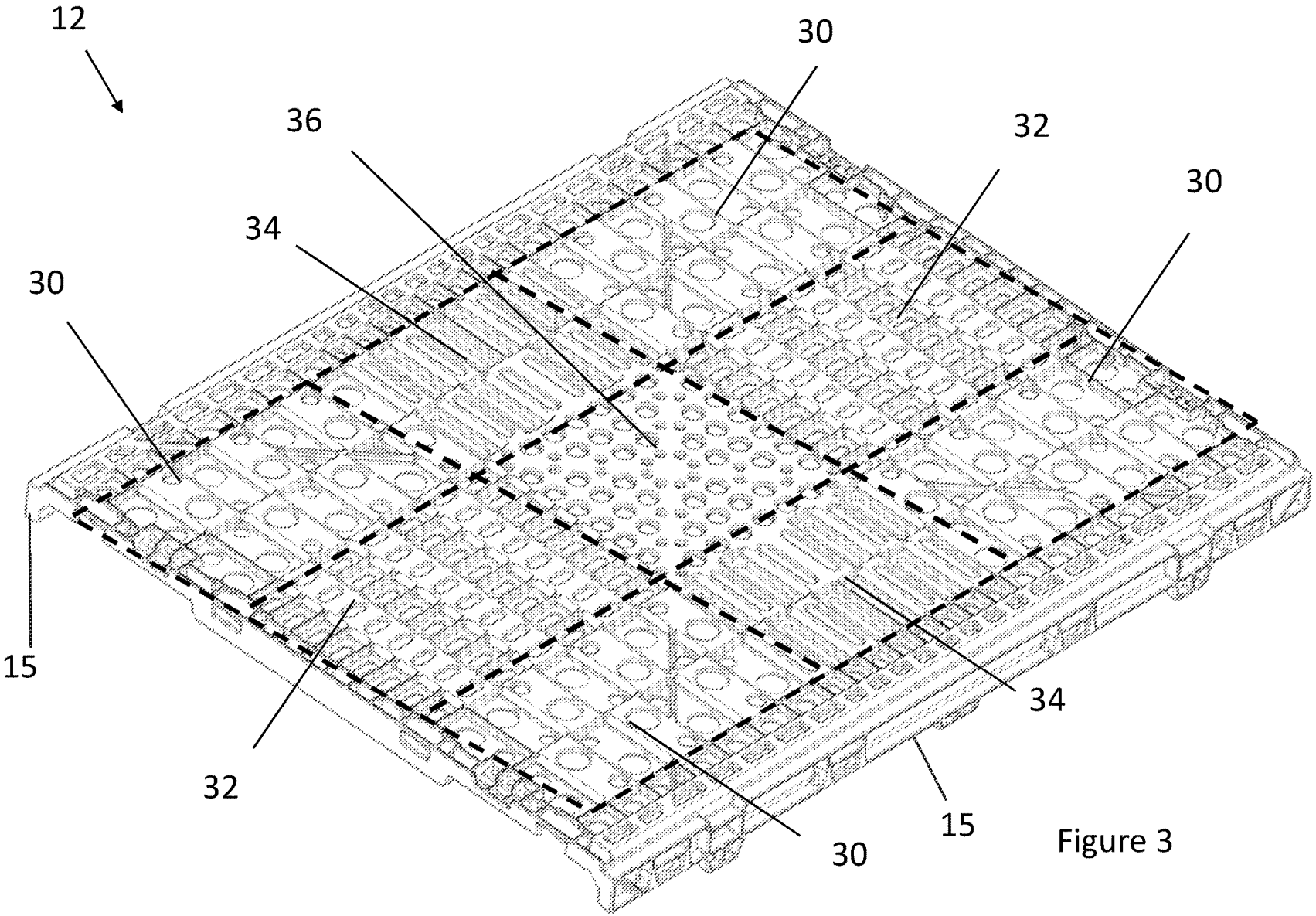
FIG. 3 is a lower perspective view of the base of FIG. 2.

FIG. 3 is a bottom perspective view of the base 12 of FIG. 2, again showing the plurality of regions indicated by broken lines. In this embodiment, the side edges of the underside of the base 12 (below the side upstanding flanges 15) are recessed relative to the remainder of the base 12.

Figure 4:
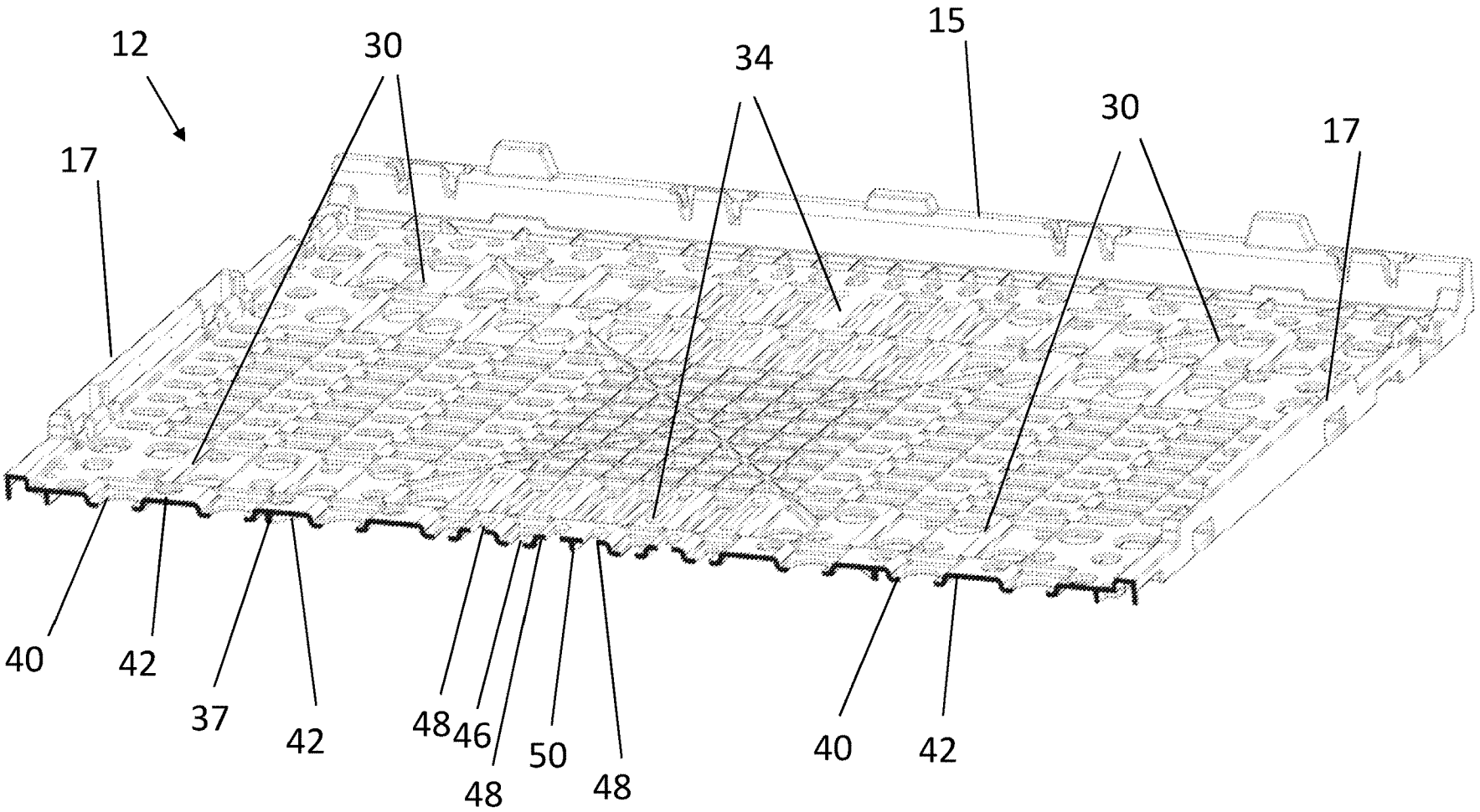
FIG. 4 shows the base of FIG. 2, partially broken away along a line parallel to the side edges.

FIG. 4 shows the base 12 of FIG. 2, partially broken away along a line parallel to the side edges and extending through two corner regions 30 and a side region 34. As shown, each corner region 30 includes a plurality of alternating raised portions 42 and recessed portions 40. Each recessed portion 40 includes a horizontal wall portion (or panel portion) at a bottom of the recessed portion 40. Each raised portion 42 includes a horizontal wall portion (or panel portion) at an upper end of the raised portion 42. Angled ribs connect each horizontal wall portion of a recessed portion 40 to an adjacent horizontal wall portion of a raised portion 42. In each corner region 30, the recessed portions 40 and raised portions 42 alternate in a checkerboard pattern. Drainage apertures are formed through every horizontal wall portion.

Where the diagonal ribs 37 intersect one of the recessed portions 40, they are recessed relative to or flush with the raised portions 42. Likewise, when one of the diagonal ribs 37 intersects one of the raised portions 42 they are recessed relative to or flush with the adjacent horizontal wall portions of the adjacent recessed portions 40.

The side regions 34 each include a plurality of mostly alternating raised portions 48 and recessed portions 46. Where there are adjacent raised portions 48, a rib 50 is defined therebetween, but the rib 50 is recessed relative to or flush with the horizontal wall portions of the nearest recessed portions 46. Drainage apertures are formed through every horizontal wall portion.

Figure 5:
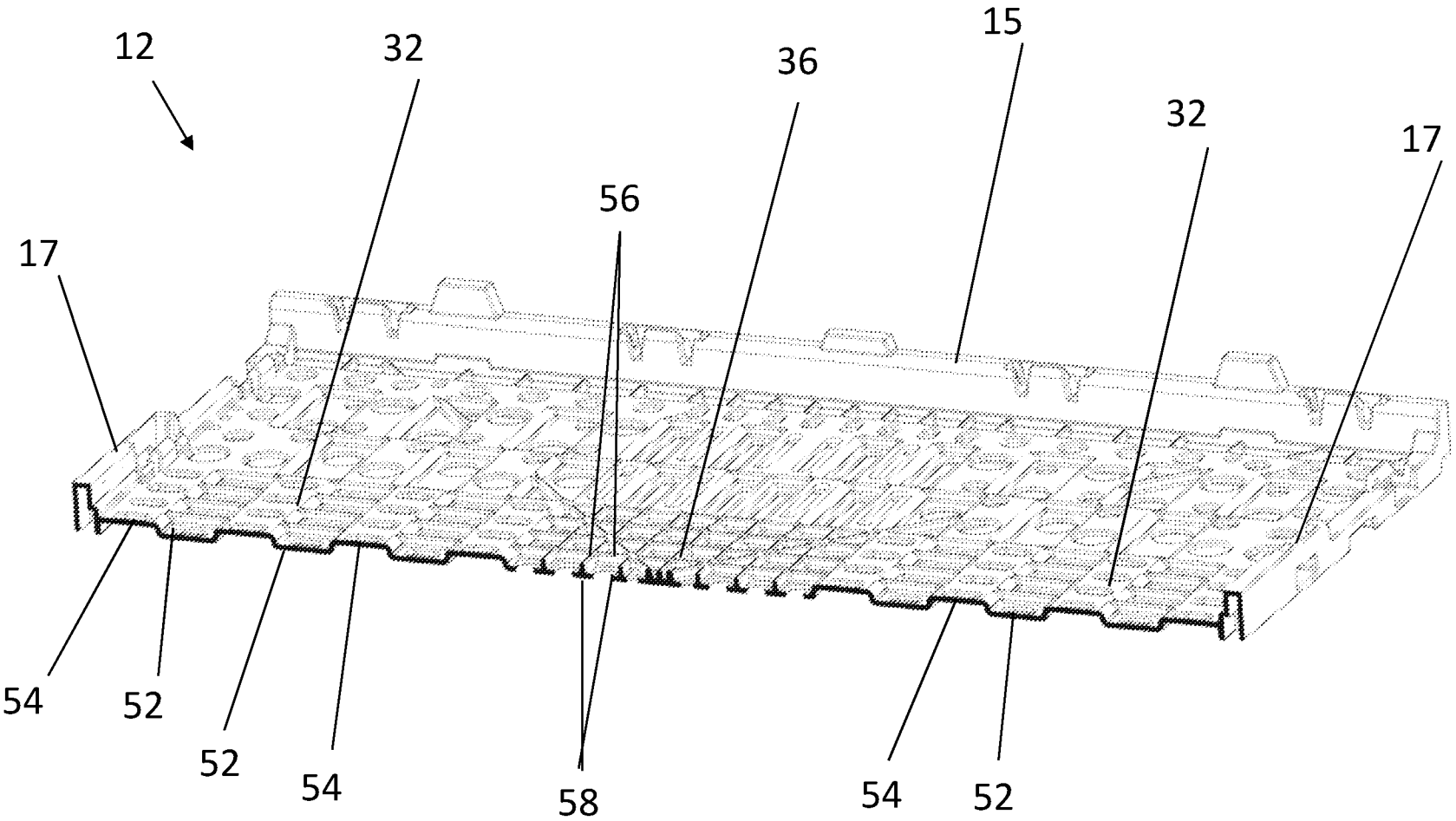
FIG. 5 is a view similar to that of FIG. 4, but broken away along a line closer to one of the side edges.

FIG. 5 is a view similar to that of FIG. 4, but broken away along a line extending through the end regions 32 and center region 36. Each end region includes a plurality of alternating rows of raised portions 54 and recessed portions 52. Within each row, the raised portions 54 and recessed portions 52 are separated from one another by a rib that flush with (or recessed relative to) the adjacent horizontal wall portions. Drainage apertures are formed through every horizontal wall portion.

In the center region 36, there are a plurality of intersecting ribs 57 extending upward from a plurality of horizontal wall portions 58 or panel portions. In the center region 36, there are no ribs exposed in the downward direction. There are only horizontal wall portions 58 at the bottom of the center region 36. This is because the center region 36 will deflect downward more than any other region because of the weight on the base 12. The center region 36 is most likely to deflect downward and contact the bag or other packaging in the crate stacked there below. The horizontal wall portions 58 will not tear the bag or other packaging. Drainage apertures are formed through every horizontal wall portion.

Figure 6:
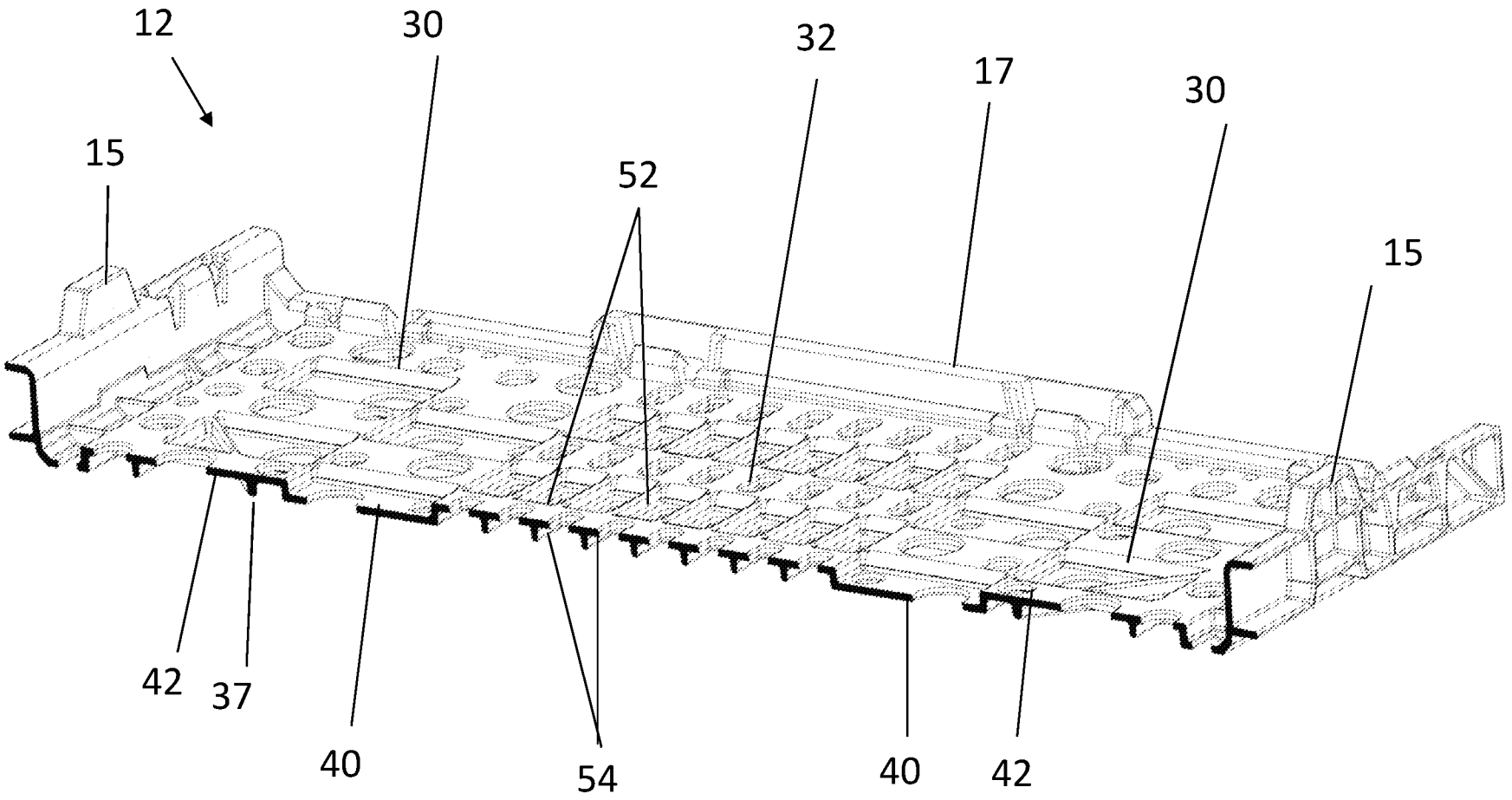
FIG. 6 shows the base 12 of FIG. 2, partially broken away along a line parallel to the end edges of the base.

FIG. 6 shows the base 12 of FIG. 2, partially broken away along a line extending through corner regions 30 and an end region 32 parallel to an end edge of the base 12. Again, in the corner regions 30, there are alternating recessed portions 40 and raised portions 42 arranged in a checkerboard pattern. Drainage apertures are formed through every horizontal wall portion.

The end region 32 includes a plurality of rows parallel to the end edge of the base 12. Each alternate row includes either a plurality of raised portions 54 or a plurality of recessed portions 52. Each raised portion 54 includes a horizontal wall portion and each raised portion is separated by a rib projecting downward from the horizontal wall portions. Likewise, each recessed portion 52 includes a horizontal wall portion at a lower end thereof. The recessed portions 52 are separated by ribs extending upward from the horizontal wall portions. Elongated apertures are formed in the horizontal wall portions of both the recessed portions 52 and the raised portions 54. The apertures are elongated in a direction parallel to the side edges of the base 12.

Figure 7:
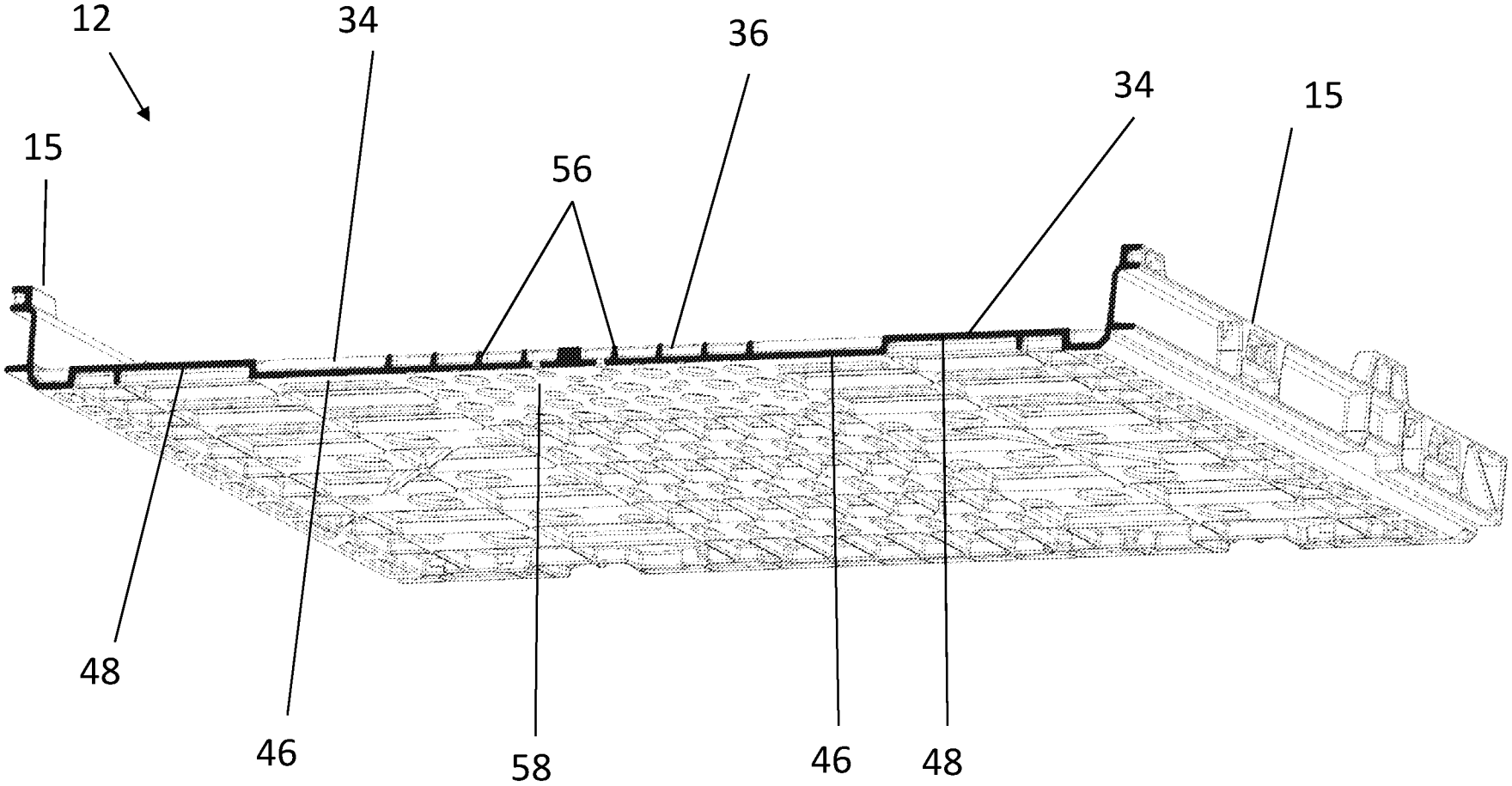
FIG. 7 is a bottom perspective view of the base of FIG. 2, partially broken away along the line parallel to the end edges and centered on the side edges.

FIG. 7 is a bottom perspective view of the base 12 of FIG. 2, partially broken away along the line parallel to the end edges and extending through side regions 34 and center region 36. As shown, the lower surface of the center region 36 has no ribs projecting downward and only has a relatively smooth, flat surface of the horizontal wall portions 58, with drainage apertures therethrough. A high concentration of intersecting ribs 56 extend upward from the horizontal wall portions 58 to further reinforce the center region 36. The side regions 34 include approximately 50% recessed portions 46 with the lower horizontal wall portions, which again will not cause damage to the bag or other plastic packaging in the crate stacked there below. Any ribs projecting downward are recessed from or flush with the horizontal wall portions 46.

Figure 8:
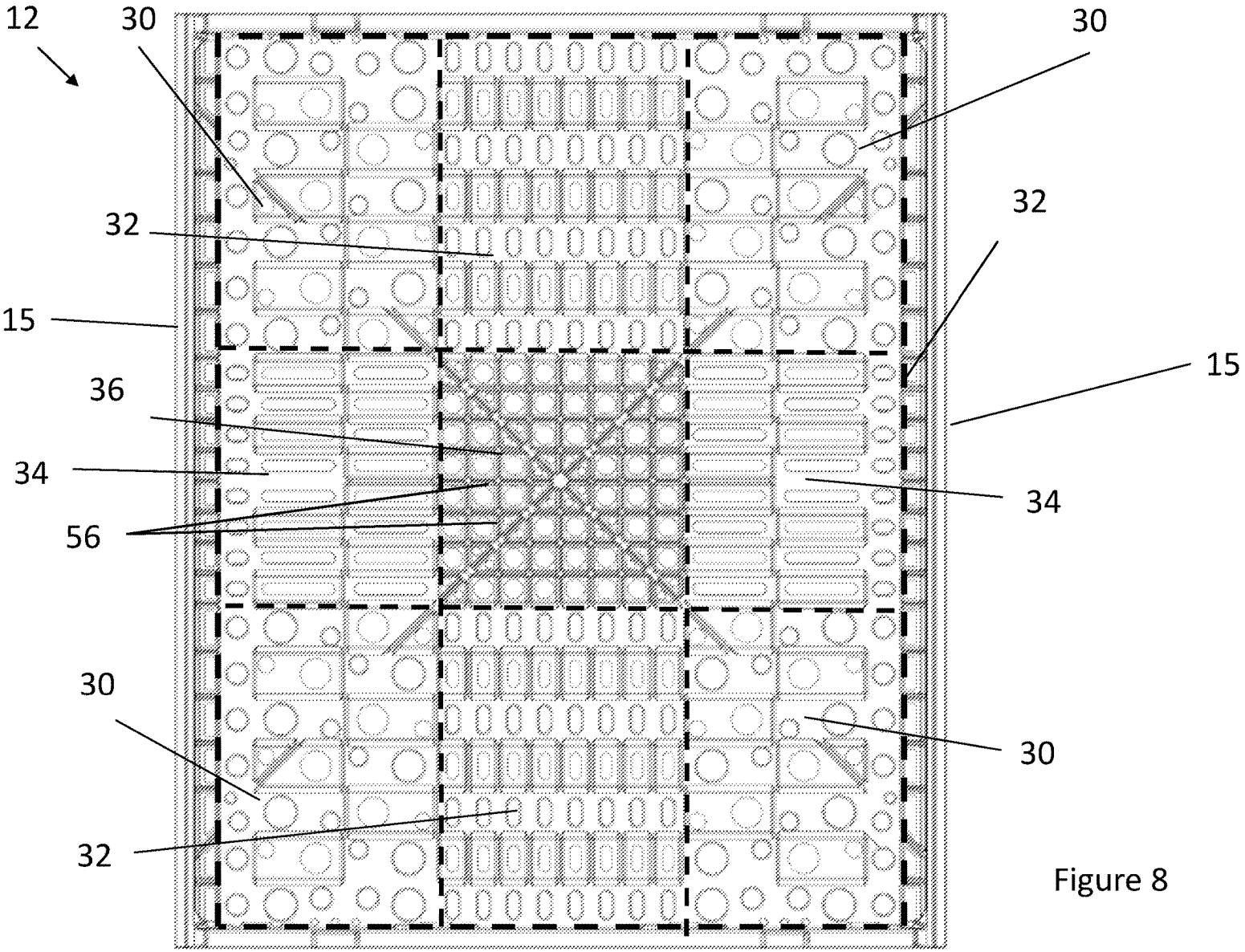
FIG. 8 is a top view of the base of FIG. 2.
Figure 9:
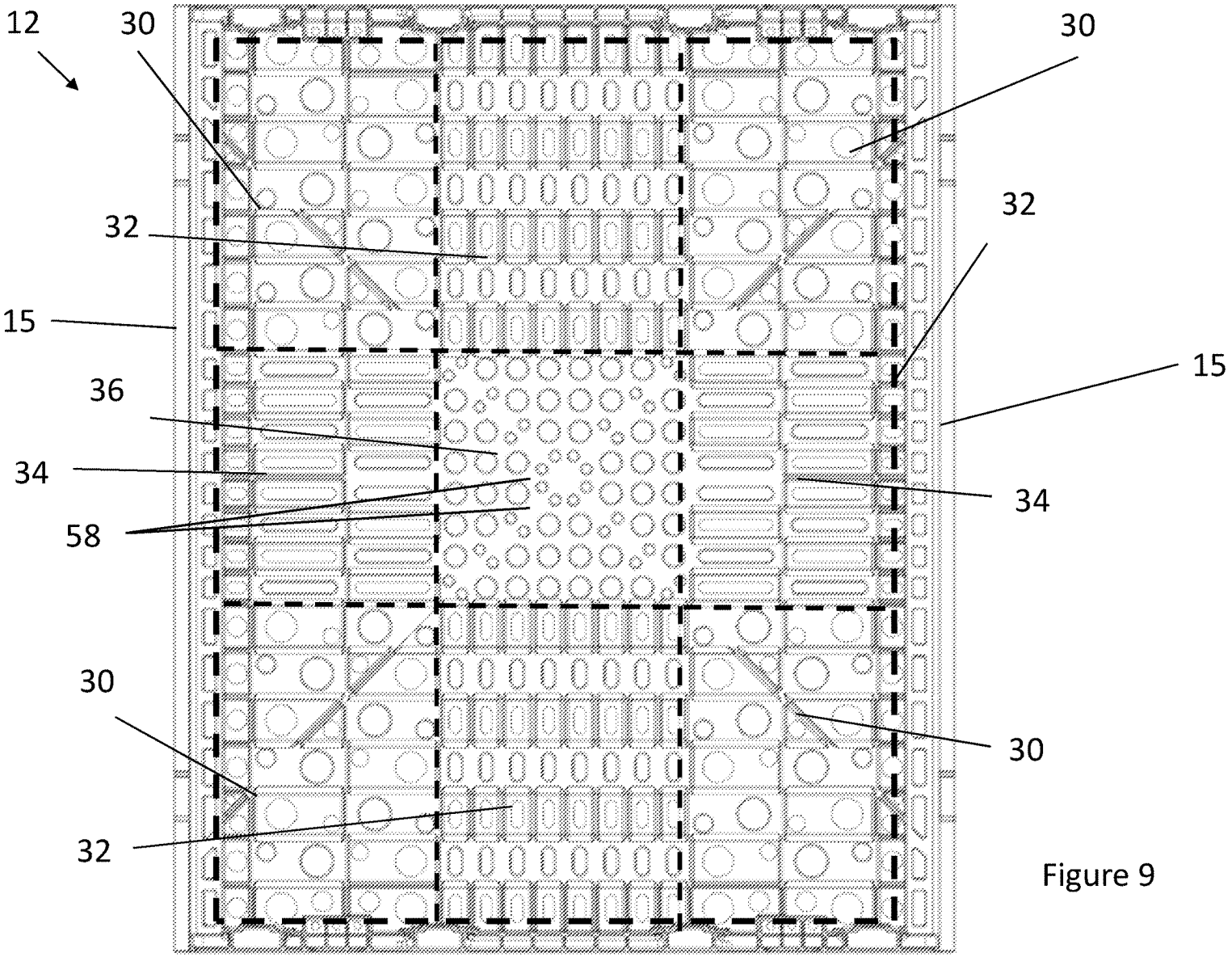
FIG. 9 is a bottom view of the base of FIG. 2.

FIG. 8 is a top view of the base 12, again showing the plurality of regions and how they are reinforced differently. FIG. 9 is a bottom view of the base 12. As can be seen in FIGS. 8 and 9, the center region 36 is approximately the same size and shape as the side regions 34 plus the space between the side regions 34 and the side upstanding flanges 15. The center region 36 is approximately a square. The corner regions 30 and end regions 32 have the same width as the side regions 34 and center region 36 but are slightly elongated because the side edges of the base 12 are longer than the end edges of the base 12. Thus the center region 36 is approximately ⅓ the width of the base 12, and slightly less than ⅓ the length of the base 12, such that the center region 36 is approximately ⅑ the area of the base 12 (but slightly less).

Figure 10:
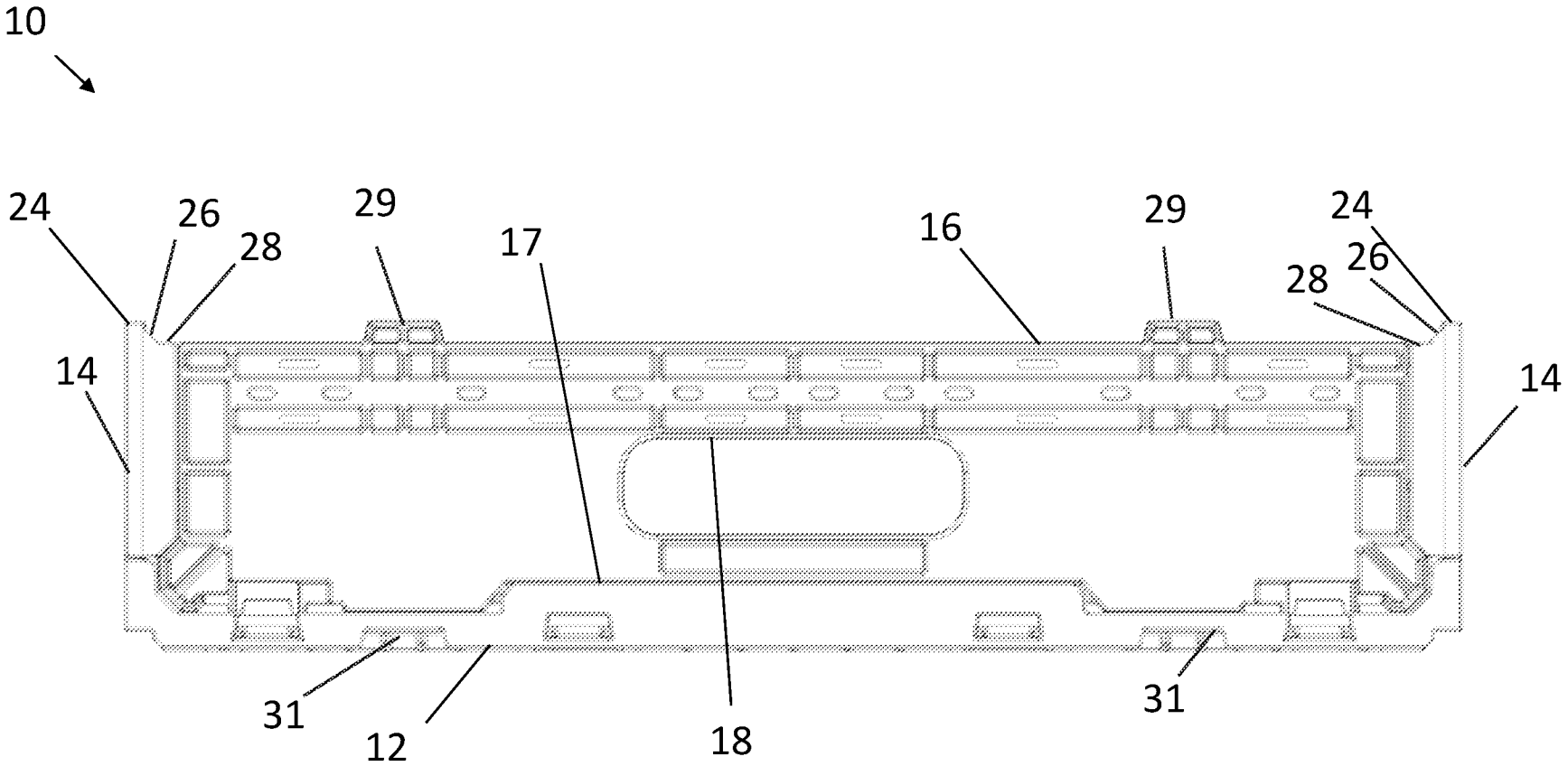
FIG. 10 is an end view of the crate of FIG. 1.

FIG. 10 is an end view of the crate 10 of FIG. 1. The end wall 16 includes a handle opening 18 therethrough and is inward of the end upstanding flange 17, which is integrally molded with the base 12. The other end wall 16 is the same. The end walls 16 are slightly shorter than the side walls 14. The side walls 14 each include an outermost portion 24 having an uppermost surface that is the highest surface of the crate 10. Just inward of the outermost portion 24 is a tapered portion 26 that leads down to a pair of small flanges 28 extending toward the end walls 16. The small flanges 28 are the same height as most of the end walls 16. The end walls 16 each include a pair of tabs 29 projecting upward. The tabs 29 are aligned with and complementary to a pair of recesses 31 at end edges of the base 12.

Figure 11:
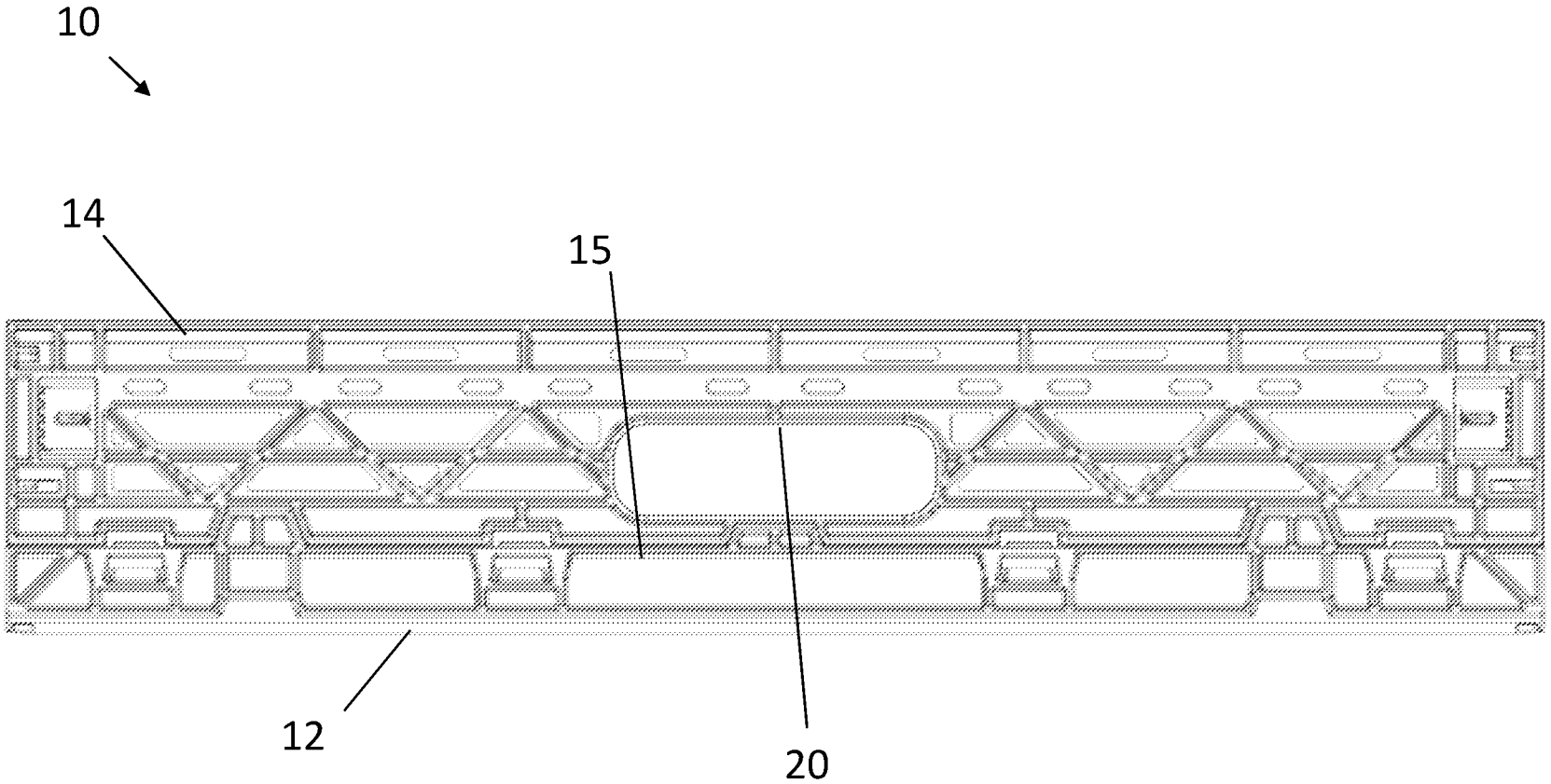
FIG. 11 is a side view of the crate of FIG. 1.

FIG. 11 is a side view of the crate 10 of FIG. 1. The side walls 14 each include a handle opening 20 therethrough. The side walls 14 are pivotably connected to the side upstanding flanges 15, which are integrally molded with the base 12. The other side wall 14 is the same.

Figure 12:
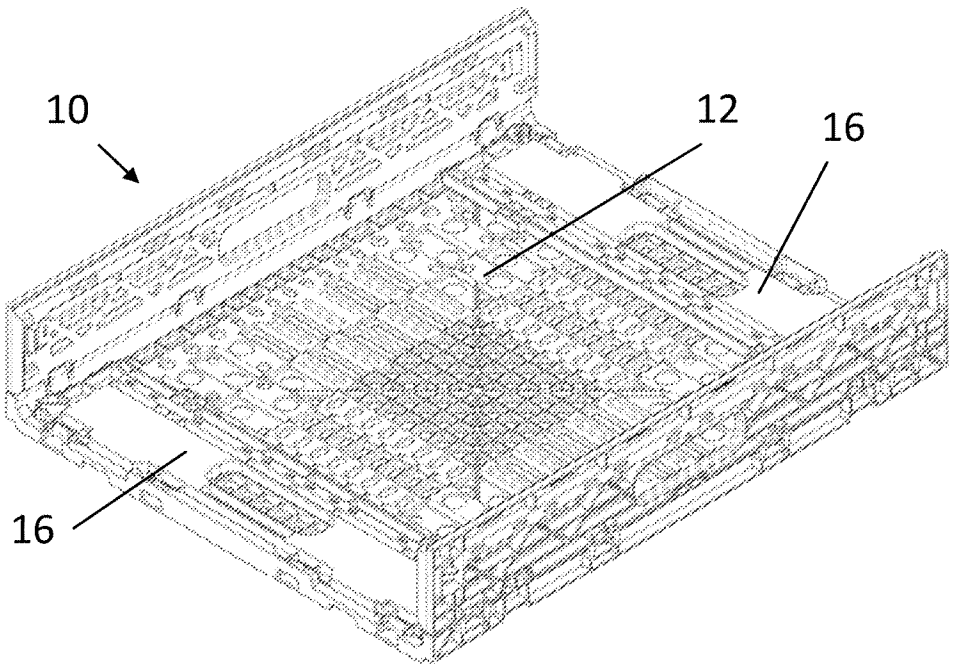
FIG. 12 shows a first step in collapsing the crate of FIG. 1.
Figure 13:
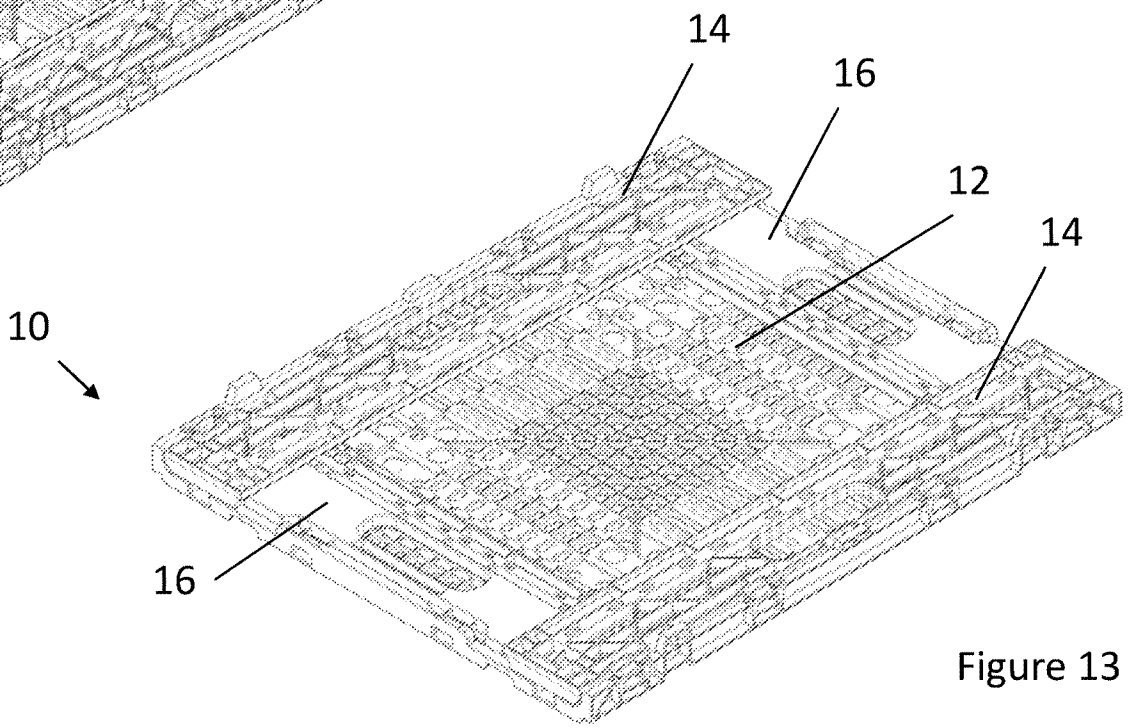
FIG. 13 shows a second step in collapsing the crate of FIG. 1.

FIG. 12 shows a first step in collapsing the crate 10. After the latches are released, the end walls 16 are folded downward directly onto the base 12. As shown in FIG. 13, the side walls 14 are then collapsed onto the base, more specifically, directly onto the end walls 16. In the collapsed figuration, the crate 10 can be efficiently stored and shipped when empty.

Figure 15:
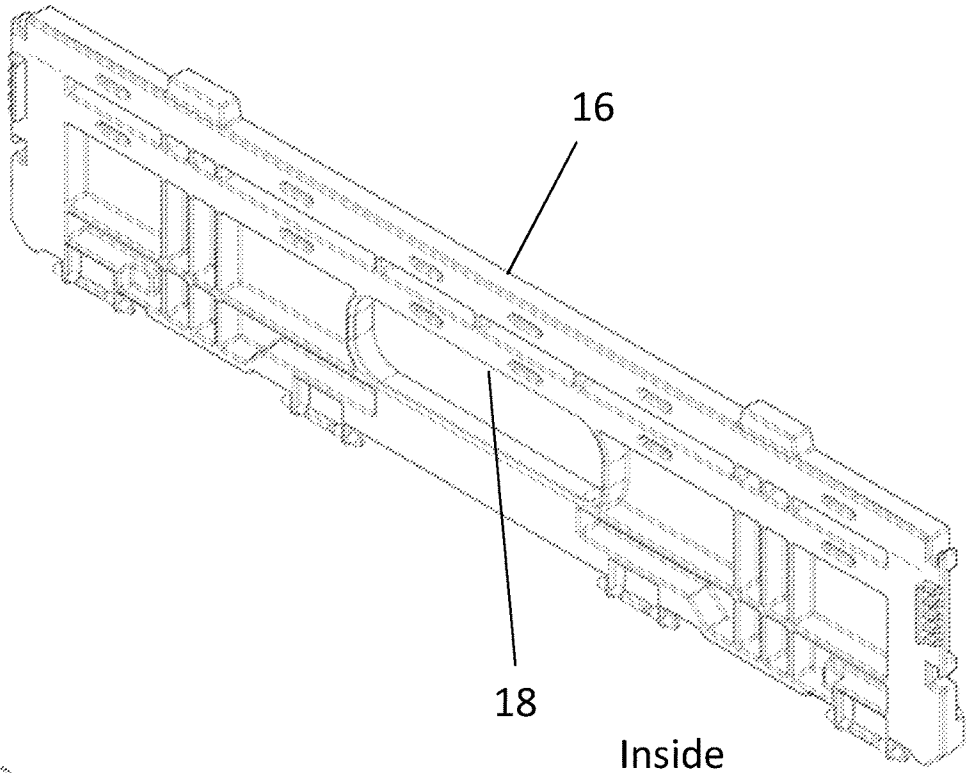
FIG. 15 is an interior view of the end wall of FIG. 14.
Figure 14:
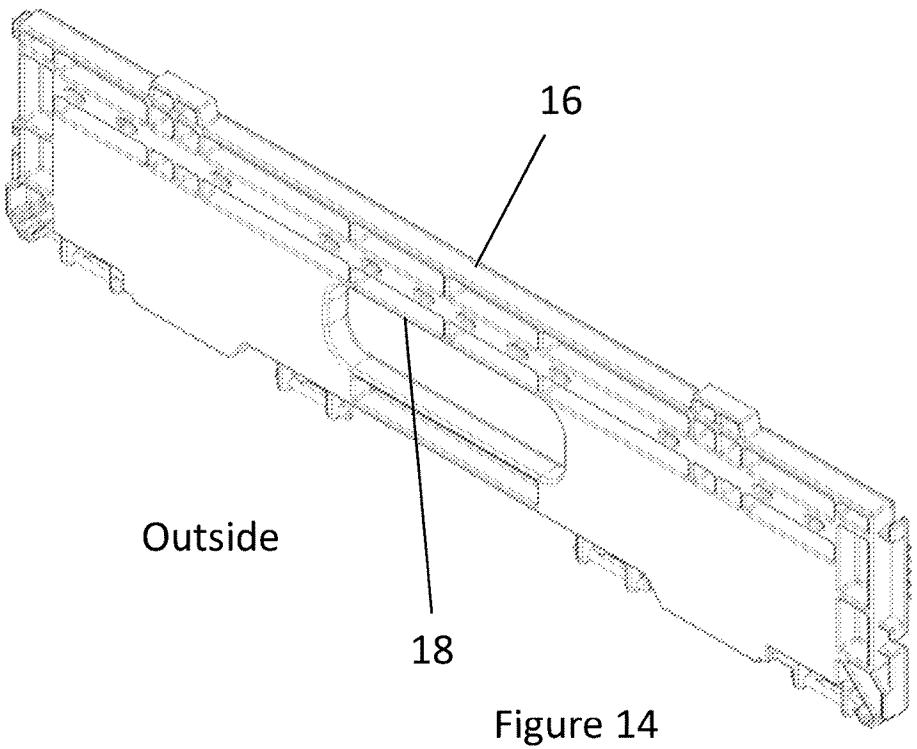
FIG. 14 is an exterior view of one of the end walls of the crate of FIG. 1.

FIG. 14 is an exterior view of one of the end walls 16. FIG. 15 is an interior view of one of the end walls 16. The other end wall 16 is the same. As shown in FIGS. 14 and 15, the end wall includes a vertical wall portion largely on the exterior surface with ribs protruding toward an interior thereof.

Figure 16:
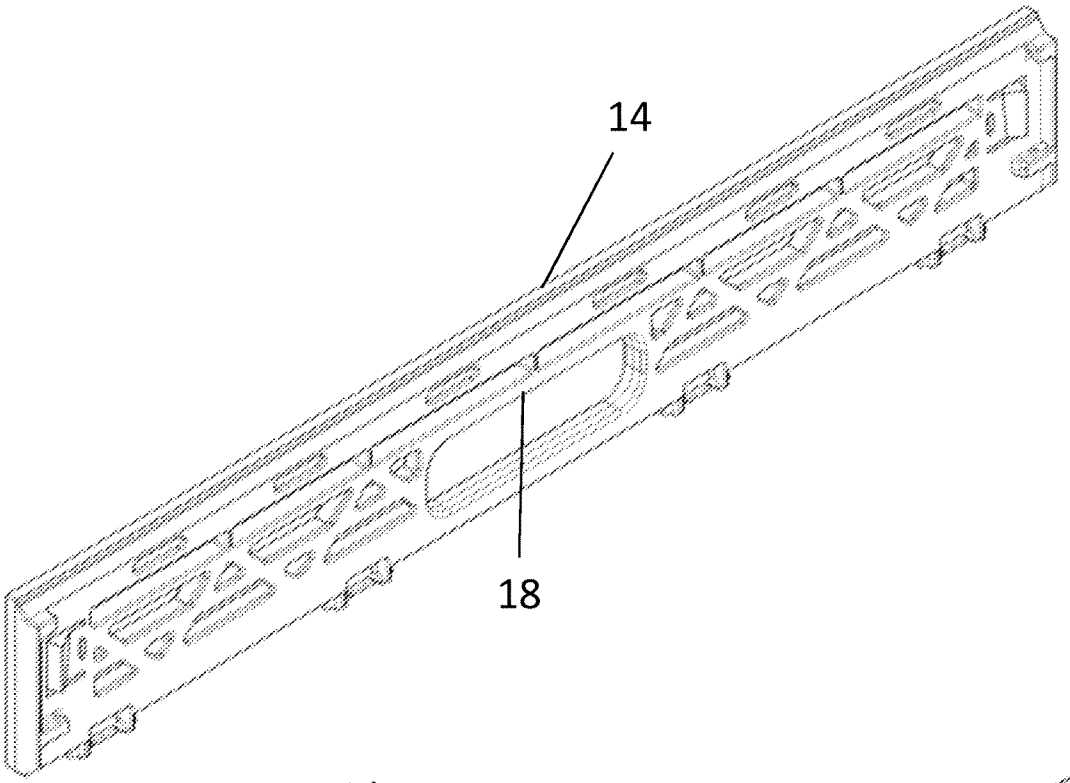
FIG. 16 is an interior view of one of the side walls of the crate of FIG. 1.
Figure 17:
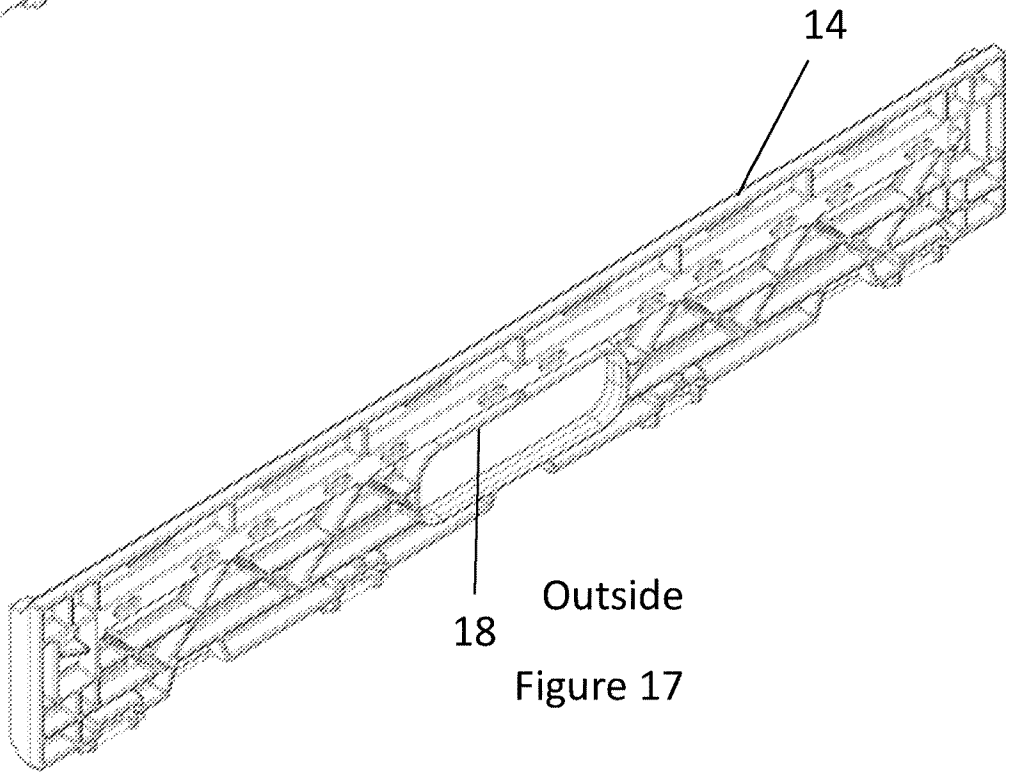
FIG. 17 is an exterior view of the side wall of FIG. 16.

FIG. 16 is an interior view of one of the side walls 14. FIG. 17 is an exterior view of one of the side walls 14. Referring to FIGS. 16 and 17, the side walls 14 include vertical wall portions substantially covering the interior surface of each side wall 14 with ribs projecting outwardly therefrom. This provides a largely smooth interior surface of each side wall 14. Again, handle openings 18 are formed through each side wall 14.

Figure 18:
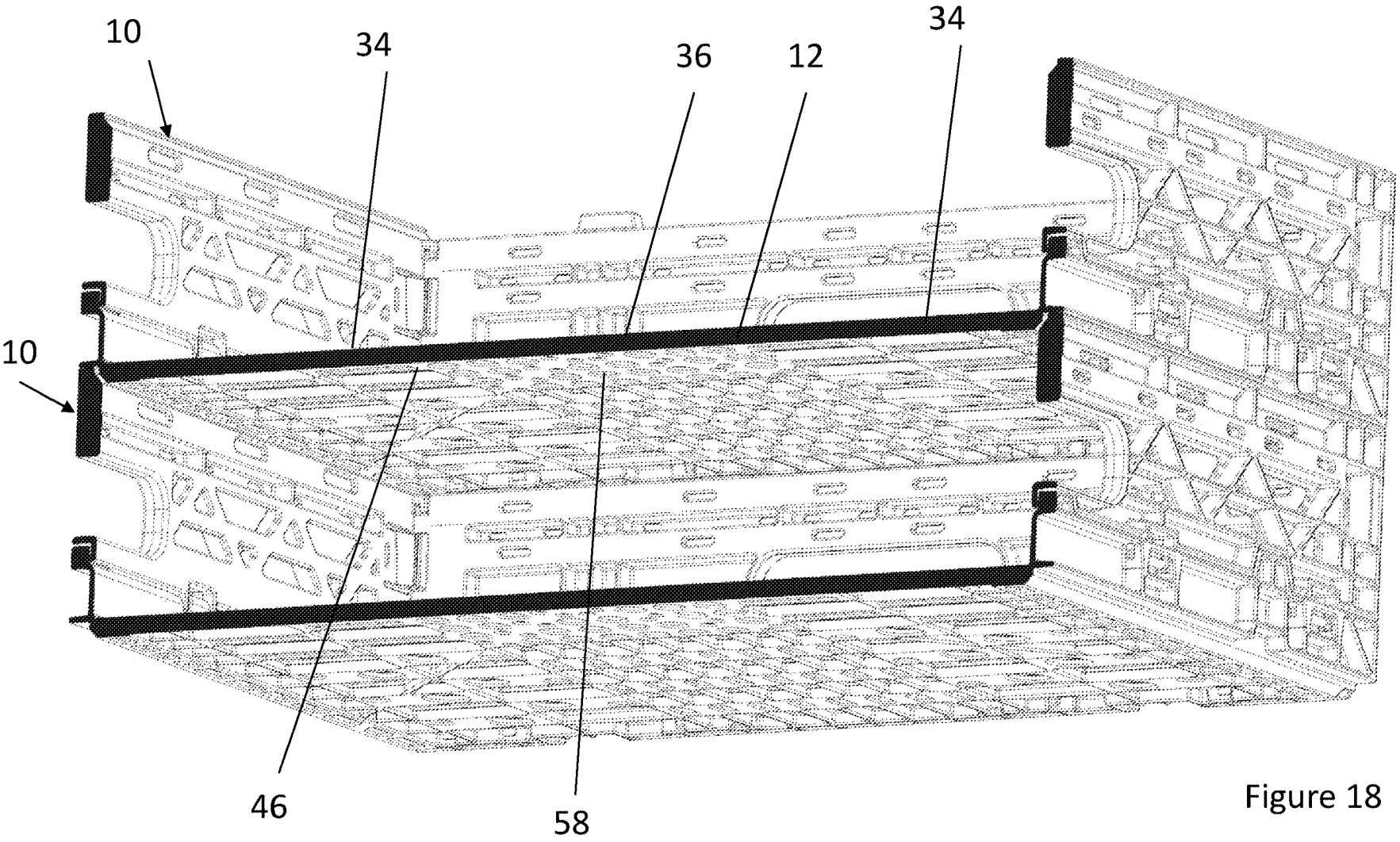
FIG. 18 is a section view through two of the crates of FIG. 1, one stacked on the other.

FIG. 18 is a section view through two crates 10, one stacked on the other. As shown, the center region 36 of the upper crate 10 has a substantially smooth, continuous lower surface, provided by the horizontal wall portions 58. The center region 36 will be deformed downwardly the most by the weight in the upper crate 10. The center region 36 will be deformed downwardly into the lower crate 10 the most and be the most likely to contact a bag or other packing in the lower crate 10. Therefore, the center region 36 is provided with the substantially smooth lower surface, which will not damage the bag or other packing in the lower crate 10.

As can also be seen in FIG. 18, the recessed side edges of the base 12 of the upper crate 10 receive the outermost portions 24 of the side walls 14 of the lower crate 10, and the side edges of the base 12 of the upper crate 10 are supported on the outermost portions 24 of the side walls 14 of the lower crate 10.

Figure 19:
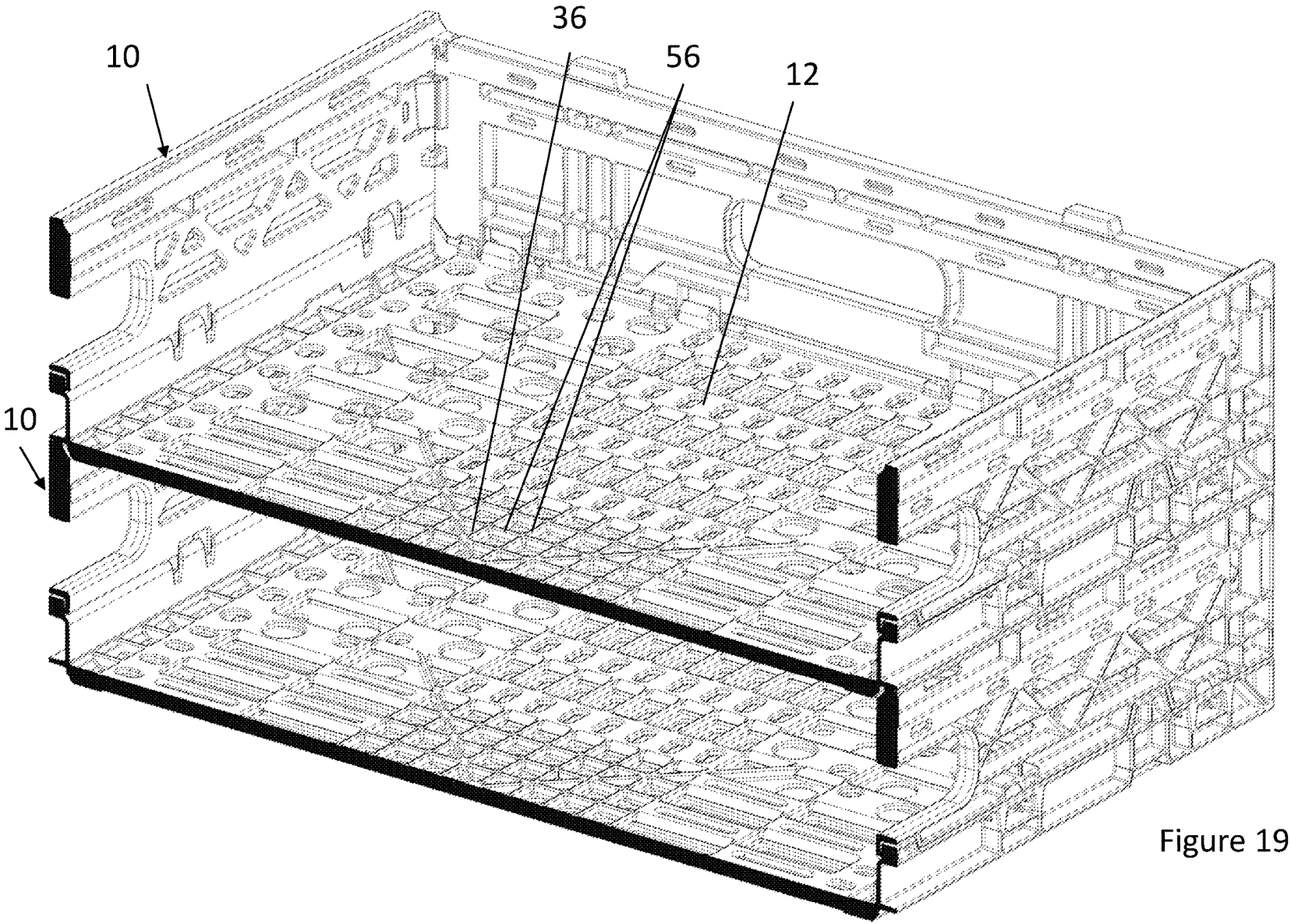
FIG. 19 is an upper perspective view of the broken-away crates of FIG. 18.

FIG. 19 is an upper perspective view of the broken-away crates 10 of FIG. 18. Again, the center region 36 is highly reinforced by a dense concentration of ribs 56 which all project upwardly.

Figure 20:
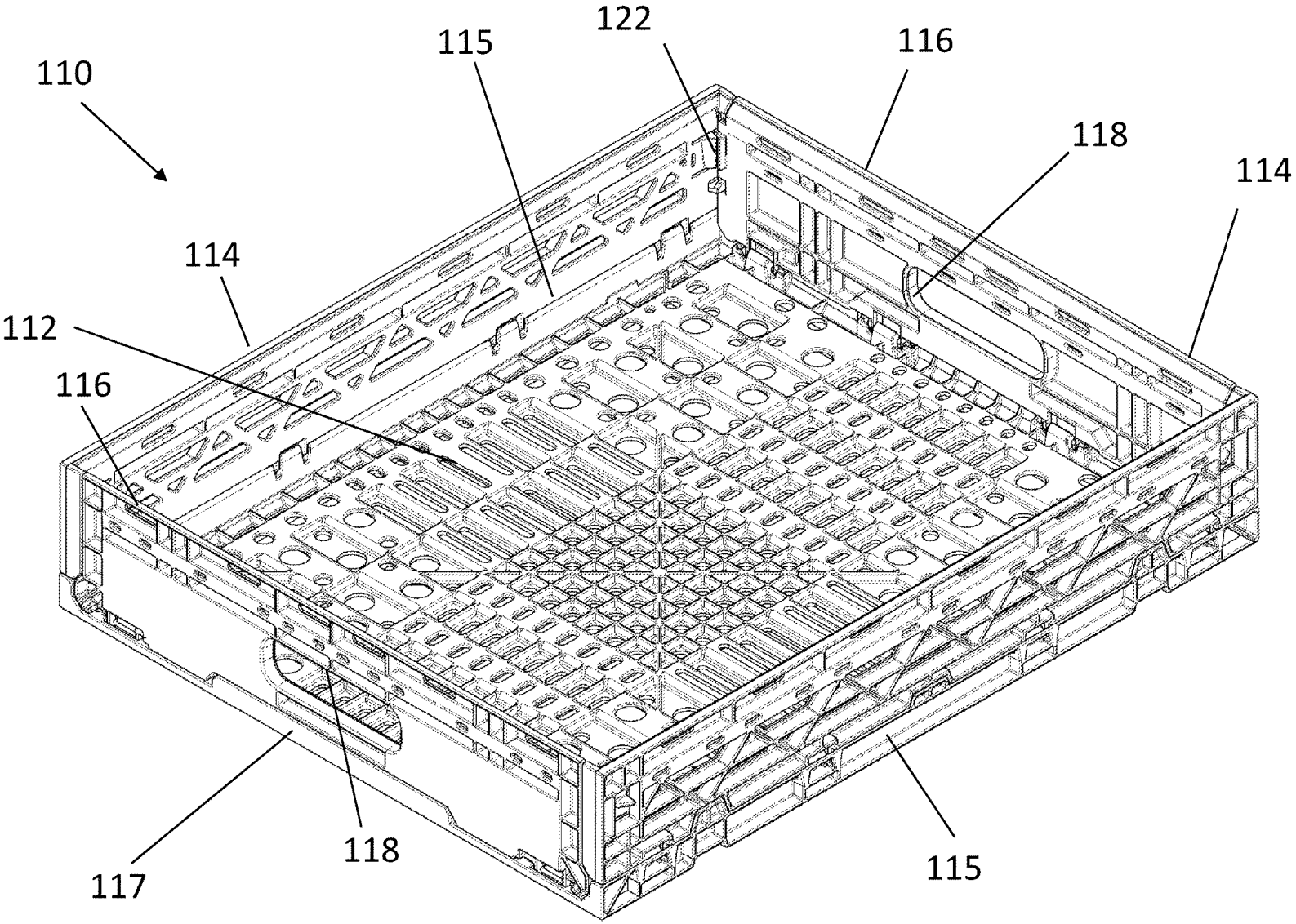
FIG. 20 is a perspective view of a crate according to a second embodiment.

FIG. 20 is a perspective view of a crate 110 according to a second embodiment. The collapsible crate 110 includes a base 112. A pair of opposed side walls 114 are pivotably connected to side upstanding flanges 115 at side edges of the base 112. A pair of opposed end walls 116 are pivotably connected at end edges of the base 112. The side upstanding flanges 115 are formed integrally with the base 112. The base 112, side walls 114 and end walls 116 are each separately integrally molded of a suitable plastic, such as by injection molding.

The end walls 116 have handle openings 118 formed therethrough. Latches 122 (only one visible) selectively connect adjacent side walls 114 and end walls 116 in a known manner. End upstanding flanges 117 project upward at ends of the base 112 and are formed integrally with the base 112.

As before, the side walls 114 each include an outermost portion having an uppermost surface that is the highest surface of the crate 110 and just inward of the outermost portion is a tapered portion. However, in this embodiment, the small flanges of the side walls 114 are the same height as the side walls 114.

Figure 21:
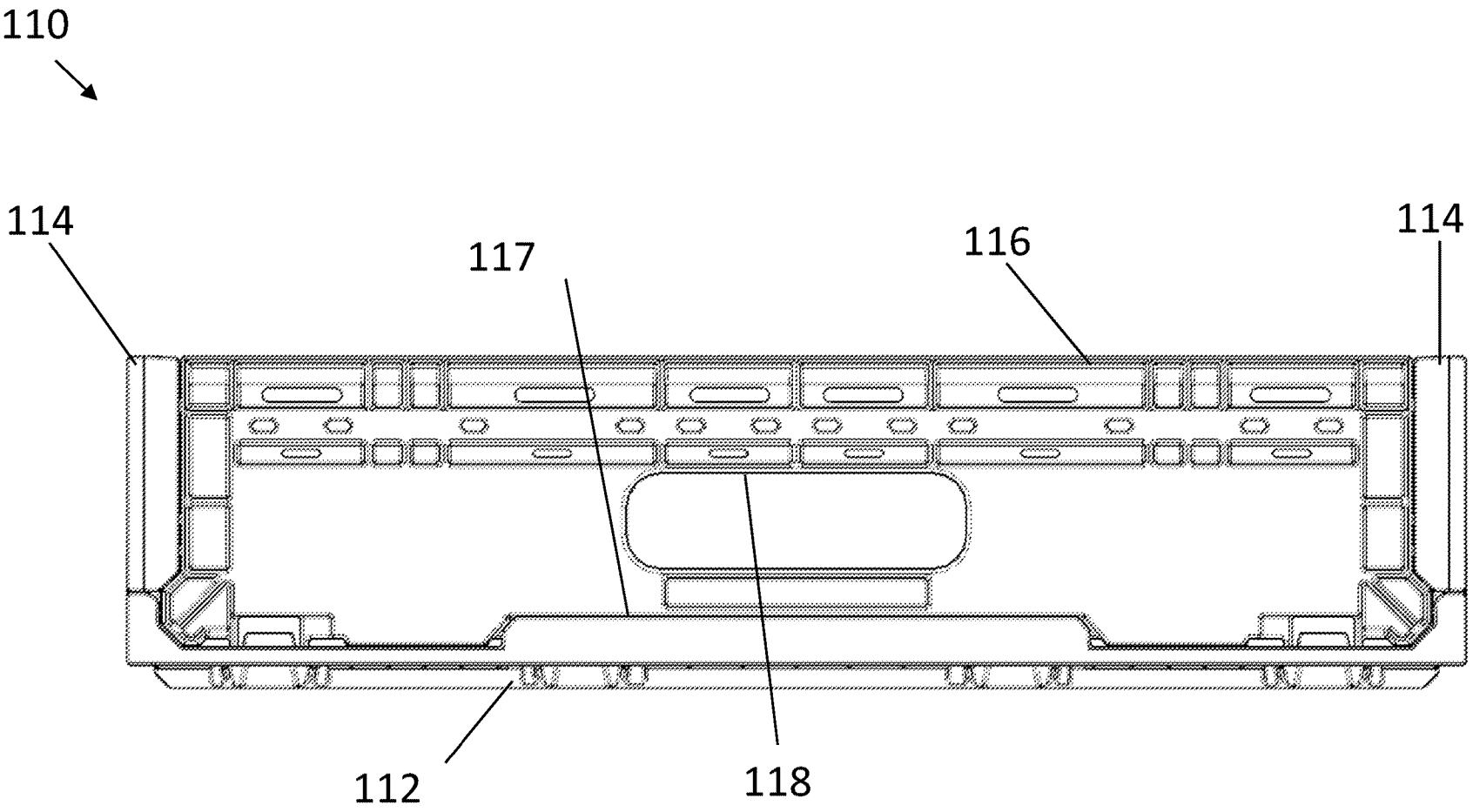
FIG. 21 is an end view of the crate of FIG. 20.

FIG. 21 is an end view of the crate 110 of FIG. 20. The end wall 116 is inward of the end upstanding flange 117. The other end wall 116 is the same. In this embodiment, the end walls 116 are the same height as the side walls 114.

Figure 22:
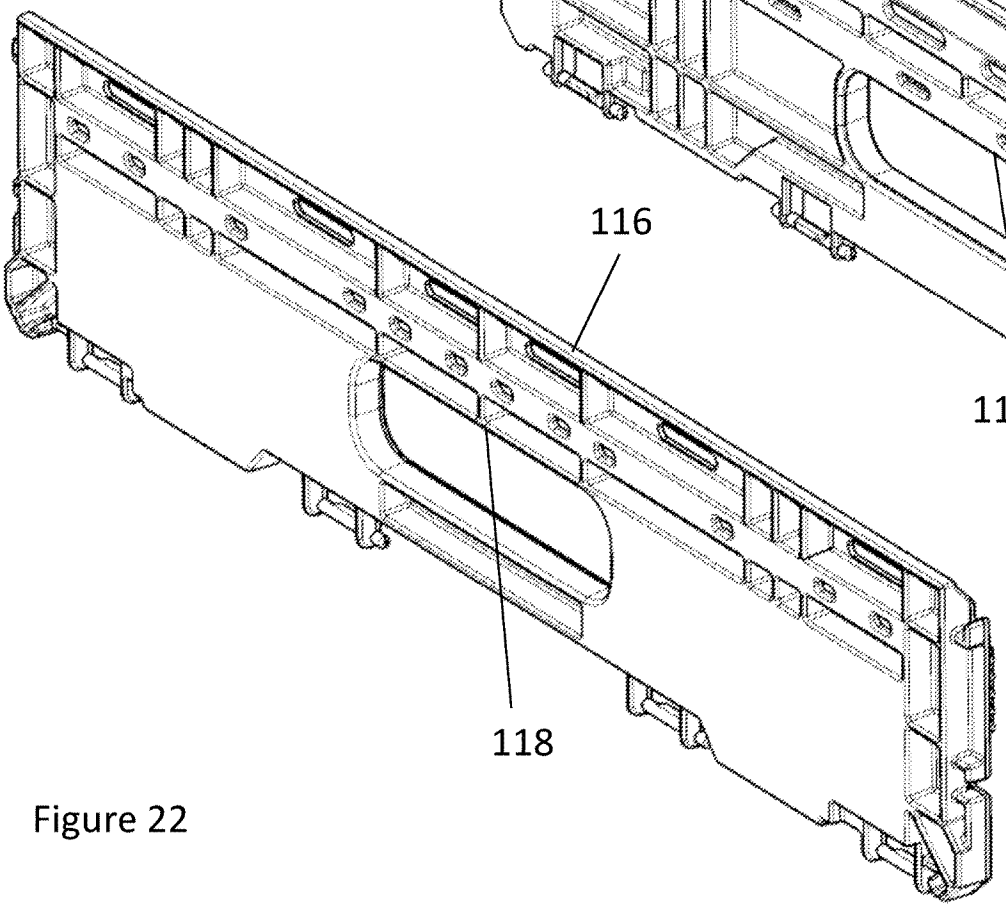
FIG. 22 is an exterior view of one of the end walls of the crate of FIG. 20.

FIG. 22 is an exterior view of one of the end walls of the crate of FIG. 20.

Figure 23:
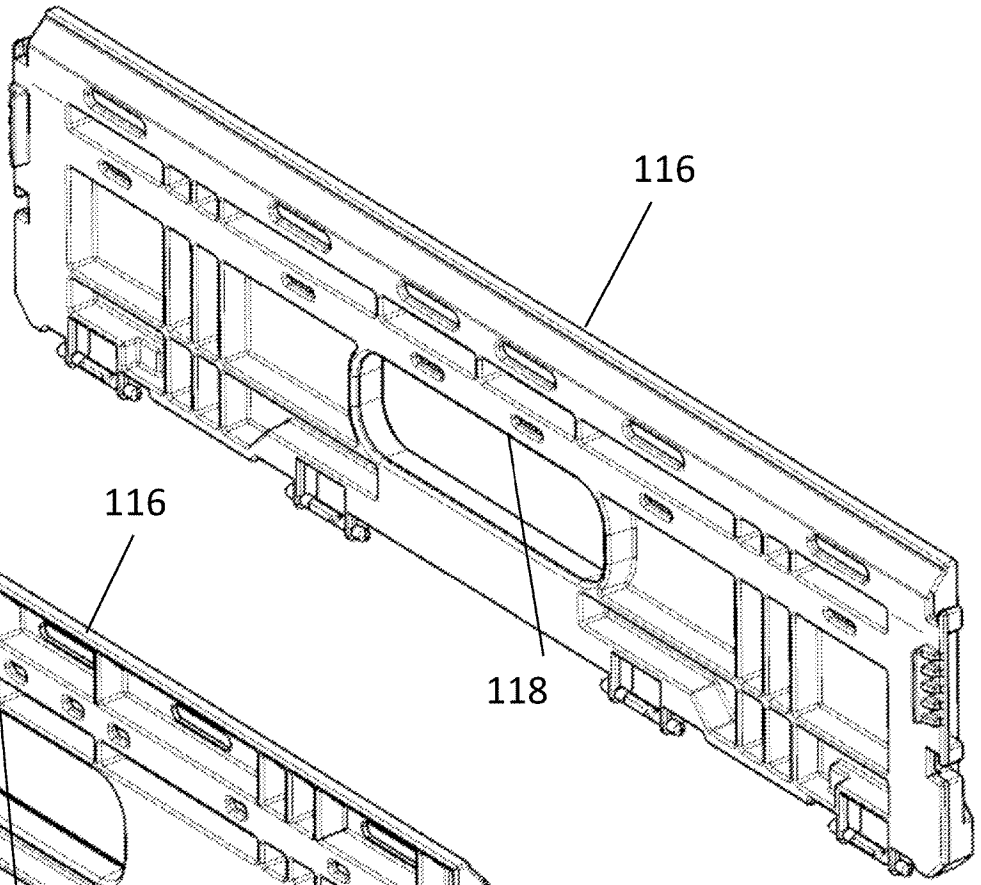
FIG. 23 is an interior view of the end wall of FIG. 22.

FIG. 23 is an interior view of the end wall of FIG. 22. In this embodiment the end walls 116 also include an outermost portion having an uppermost surface that is in an uppermost plane of the crate 110. Just inward of the outermost portion is a tapered portion.

Figure 24:
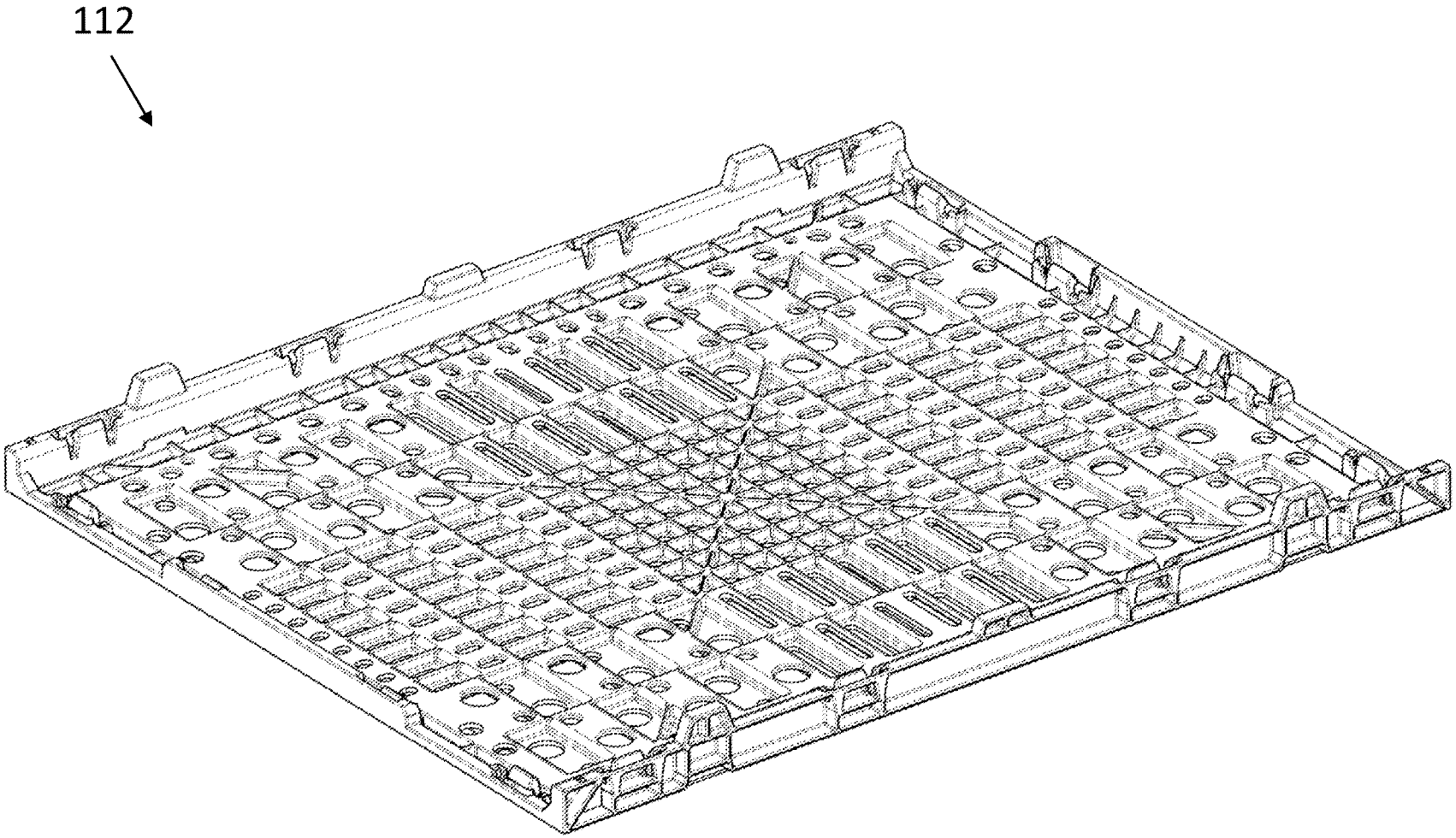
FIG. 24 is an upper perspective view of the base of the crate of FIG. 20.
Figure 25:
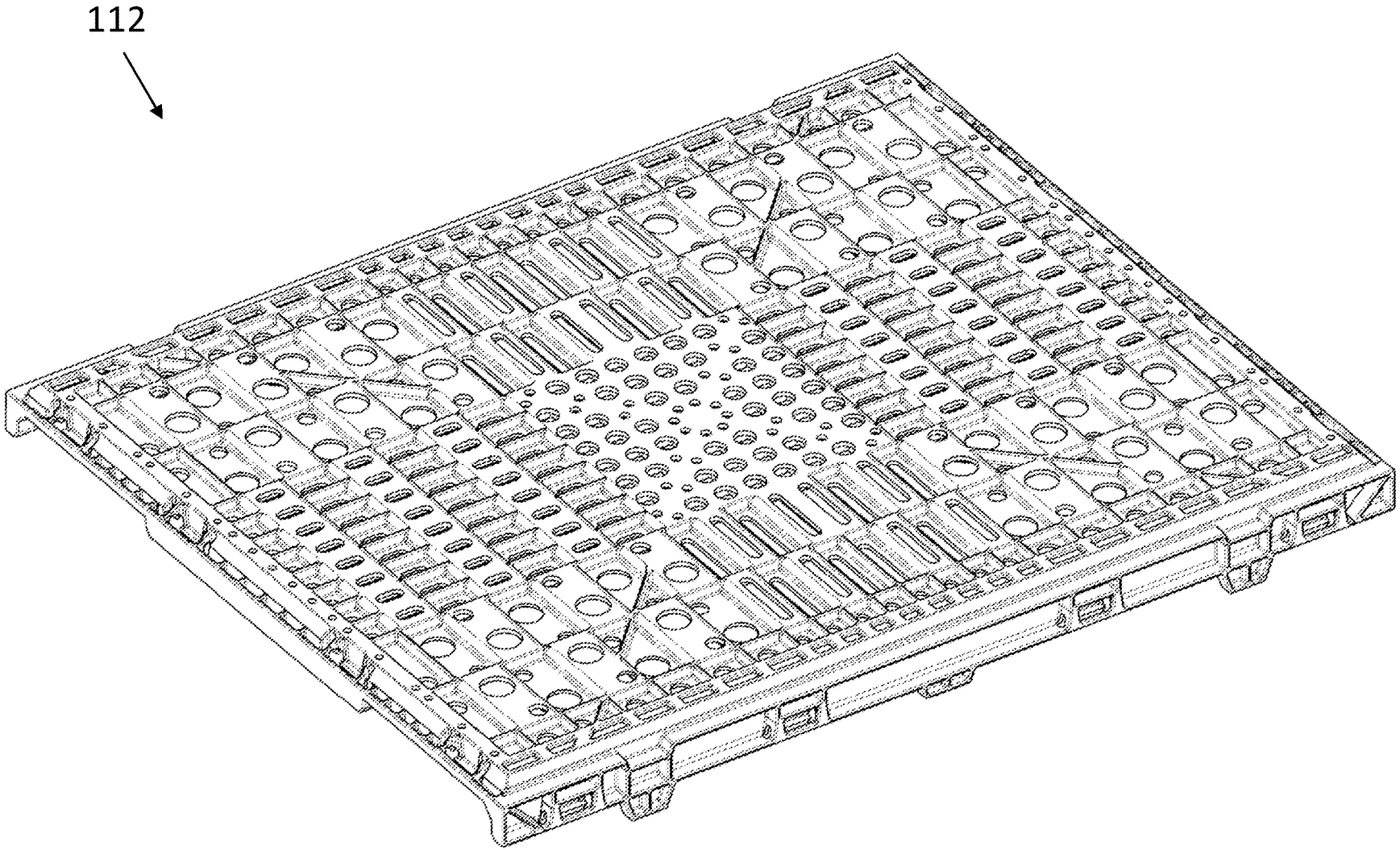
FIG. 25 is a lower perspective view of the base of FIG. 24.

FIG. 24 is an upper perspective view of the base 112 of the crate 110 of FIG. 20. FIG. 25 is a lower perspective view of the base 112 of FIG. 24. In this embodiment, the side edges and the end edges of the underside of the base 112 are recessed relative to the remainder of the base 112. The recessed side edges of the base 112 would receive and stack on the outermost portions of the side walls 114 of an identical crate 110 on which it is stacked, similar to the first embodiment (FIG. 18). In this embodiment, the recessed end edges of the base 112 would receive and stack on the outermost portions of the end walls 116 of a lower crate 110 in the same way.

In accordance with the provisions of the patent statutes and jurisprudence, exemplary configurations described above are considered to represent preferred embodiments of the inventions. However, it should be noted that the inventions can be practiced otherwise than as specifically illustrated and described without departing from its spirit or scope. Alphanumeric identifiers on method steps are solely for ease in reference in dependent claims and such identifiers by themselves do not signify a required sequence of performance, unless otherwise explicitly specified.

What is claimed is:

1. A container comprising:

a base, the base including a center region having a plurality of horizontal wall portions and a plurality of ribs extending upward from the plurality of horizontal wall portions, wherein the plurality of ribs extend from the plurality of horizontal wall portions to free ends, wherein the plurality of ribs includes a plurality of first ribs and a plurality of second ribs, the plurality of first ribs extending perpendicularly to and intersecting the plurality of second ribs; and a plurality of walls extending upward from the base.

2. The container of claim 1 wherein there are no ribs projecting downward of the plurality of horizontal wall portions in the center region.

3. The container of claim 2 wherein the center region is approximately ⅓ a width of the base.

4. The container of claim 3 wherein the plurality of walls are pivotably connected to the base and movable between an upright position and a collapsed position on the base.

5. The container of claim 3 wherein the plurality of first ribs extend parallel to side edges of the base, and the plurality of second ribs extend parallel to end edges of the base, the plurality of ribs further including diagonal ribs extending diagonally relative to the base.

6. The container of claim 5 wherein the base further includes a plurality of corner regions each including a plurality of alternating raised portions and recessed portions, wherein each raised portion includes an upper panel portion and each recessed portion includes a lower panel portion.

7. The container of claim 6 wherein the diagonal ribs extend through the center region and the plurality of corner regions.

8. The container of claim 1 wherein the center region is less than ⅓ a length of the base.

9. The container of claim 1 wherein the plurality of first ribs extend parallel to side edges of the base and the plurality of second ribs extend parallel to end edges of the base.

10. The container of claim 1 wherein there are no projections downward in the center region.

11. The container of claim 3 wherein there are no projections downward in the center region.

12. A container comprising:

a base having end edges and side edges, the base including a plurality of regions including a center region, corner regions, side regions between the corner regions and between the center region and the side edges, and end regions between the corner regions and between the center region and the end edges, wherein the center region is reinforced differently from the side regions, end regions, and corner regions, wherein the corner regions are reinforced differently from the side regions and the end regions, wherein there are no ribs projecting downward in the center region, wherein the center region has a plurality of lower panel portions and a plurality of ribs extending upward from the plurality of lower panel portions to free ends, wherein the plurality of ribs includes a plurality of first ribs intersecting a plurality of second ribs wherein the plurality of second ribs extends parallel to end edges of the base; and a plurality of walls extending upward from the side edges and the end edges of the base.

13. The container of claim 12 wherein the center region is approximately ⅓ a width of the base.

14. The container of claim 13 wherein the plurality of walls are pivotably connected to the base and movable between an upright position and a collapsed position on the base.

15. The container of claim 14 wherein the plurality of ribs includes a plurality of first ribs extending parallel to side edges of the base, a plurality of second ribs extending parallel to end edges of the base, and diagonal ribs extending diagonally relative to the base.

16. The container of claim 15 wherein the corner regions each include a plurality of alternating raised portions and recessed portions, wherein each raised portion includes an upper corner panel portion and each recessed portion includes a lower corner panel portion.

17. The container of claim 16 wherein the diagonal ribs extend through the center region and the corner regions.

18. A container comprising:

a base having end edges and side edges, the base including a plurality of regions including a center region, corner regions, side regions between the corner regions and between the center region and the side edges, and end regions between the corner regions and between the center region and the end edges, wherein the center region is reinforced differently from the side regions, end regions, and corner regions, wherein the corner regions are reinforced differently from the side regions and the end regions, wherein the center region has a plurality of lower panel portions and a plurality of ribs extending upward from the plurality of lower panel portions to free ends, the plurality of ribs including a plurality of first ribs and a plurality of second ribs, the plurality of first ribs extending perpendicularly to and intersecting the plurality of second ribs; and a plurality of walls pivotably connected to the side edges and the end edges of the base and movable between an upright position and a collapsed position on the base.

19. The container of claim 18 wherein the corner regions each include a plurality of raised portions and a plurality of recessed portions alternatingly arranged in a checkerboard pattern, wherein each raised portion includes an upper corner panel portion and each recessed portion includes a lower corner panel portion.

20. The container of claim 19 wherein each upper corner panel portion and each lower corner panel portion includes a drainage aperture therethrough.

21. The container of claim 19 further including a diagonal rib extending through the center region and two of the corner regions, and wherein the diagonal rib is recessed relative to or flush with adjacent ones of the plurality of recessed portions where the diagonal rib intersects one of the plurality of raised portions.

22. The container of claim 18 wherein the side regions each include a plurality of raised portions and a plurality of recessed portions, each including a horizontal wall portion having a drainage aperture therethrough.

* * * * *